US009995060B2

(12) United States Patent
Miller et al.

(10) Patent No.: US 9,995,060 B2
(45) Date of Patent: Jun. 12, 2018

(54) DEAD BOLT LOCK SYSTEM AND METHOD OF RETRACTING A DEAD BOLT

(71) Applicant: Lockmasters Technologies Inc., Nicholasville, KY (US)

(72) Inventors: J. Clayton Miller, Titusville, FL (US); Eric C. Elkins, Nicholasville, KY (US); Michael S. Yacobi, Lexington, KY (US); Edmund P. Deja, Lexington, KY (US); Lynn D. Damron, Versailles, KY (US); Danny R Maynard, Lexington, KY (US)

(73) Assignee: Lockmasters Technologies Inc., Nicholasville, KY (US)

( * ) Notice: Subject to any disclaimer, the term of this patent is extended or adjusted under 35 U.S.C. 154(b) by 600 days.

(21) Appl. No.: 14/251,915

(22) Filed: Apr. 14, 2014

(65) Prior Publication Data

US 2015/0292245 A1 Oct. 15, 2015

(51) Int. Cl.

| | |
|---|---|
| ***E05B 65/10*** | (2006.01) |
| ***E05B 47/06*** | (2006.01) |
| *E05B 47/00* | (2006.01) |

(52) U.S. Cl.

CPC ..... *E05B 47/0603* (2013.01); *E05B 65/10* (2013.01); *E05B 65/1073* (2013.01); *E05B 2047/0067* (2013.01); *E05B 2047/0069* (2013.01); *E05B 2047/0086* (2013.01)

(58) Field of Classification Search

CPC .. E05B 47/0603; E05B 65/1073; E05B 65/10; E05B 2047/0067; E05B 2047/0086; E05B 2047/0069

USPC ..... 70/467, 469, 483–485, 150, 153, 210, 70/283, DIG. 63, 223, 422, 472, 131, 284, 70/285, 92; 109/59 R, 59 T; 292/92, 292/DIG. 22, DIG. 63, DIG. 60, 21

See application file for complete search history.

(56) References Cited

U.S. PATENT DOCUMENTS

| | | | |
|---|---|---|---|
| 450,290 | A | 4/1891 | Hansen |
| 780,181 | A | 1/1905 | Holden |
| 928,904 | A | 7/1909 | Cottrell |

(Continued)

FOREIGN PATENT DOCUMENTS

| | | |
|---|---|---|
| DE | 302222 | 12/1917 |
| DE | 498939 | 5/1930 |

(Continued)

*Primary Examiner* — Lloyd A Gall

(74) *Attorney, Agent, or Firm* — Wood Herron & Evans LLP

(57) ABSTRACT

A dead bolt lock system including a slider member operatively coupled to a dead bolt such that when the slider member is in a first position, the dead bolt is in an extended position. When the slider member is in a second position, the dead bolt is in the retracted position. The system also includes a first movable member positioned in a path of movement of the slider member and configured to be displaced by the slider member to allow the slider member to move to the second position. The system includes a first lock having a first condition preventing the displacement of the first movable member and a second condition allowing the displacement of the first movable member, a second lock having a first condition preventing the displacement of the first movable member and a second condition allowing the displacement of the first movable member.

27 Claims, 31 Drawing Sheets

(56) References Cited

U.S. PATENT DOCUMENTS

| | | | | |
|---|---|---|---|---|
| 943,143 | A | 12/1909 | Draper | |
| 1,288,816 | A | 12/1918 | Bolles | |
| 1,496,894 | A | 6/1924 | Krautter | |
| 1,512,939 | A | 10/1924 | Ledin | |
| 1,604,866 | A | 10/1926 | Wildrick | |
| 1,630,141 | A | 5/1927 | Soemer | |
| 1,756,667 | A | 4/1930 | Soemer | |
| 1,805,997 | A | 5/1931 | Rhiner | |
| 1,897,080 | A | 2/1933 | Soper | |
| 2,077,620 | A * | 4/1937 | Dicke | E01B 7/02 174/138 D |
| 2,233,828 | A | 3/1941 | Andersen | |
| 2,241,109 | A | 5/1941 | Bock | |
| 2,243,179 | A | 5/1941 | Whittier | |
| 2,485,042 | A | 10/1949 | Friend | |
| 2,524,696 | A | 10/1950 | Ellis | |
| 2,594,253 | A | 4/1952 | Vander Veer | |
| 2,843,409 | A | 7/1958 | Johannesen | |
| 2,872,233 | A | 2/1959 | Bordner, Jr. | |
| 2,958,215 | A | 11/1960 | Heyman | |
| 3,073,143 | A | 1/1963 | Eads | |
| 3,271,062 | A | 9/1966 | Schelin | |
| 3,339,959 | A | 9/1967 | Krantz | |
| 3,633,388 | A | 1/1972 | Atkinson | |
| 3,719,248 | A | 3/1973 | Breitschwerdt et al. | |
| 3,774,420 | A | 11/1973 | Orr | |
| 3,796,073 | A | 3/1974 | Guiraud | |
| 3,799,596 | A | 3/1974 | Nozomu et al. | |
| 3,865,414 | A | 2/1975 | Schlage | |
| 3,869,159 | A | 3/1975 | Eads | |
| 3,958,820 | A | 5/1976 | Teeple | |
| 4,003,593 | A | 1/1977 | Wilzig et al. | |
| 4,006,471 | A | 2/1977 | Pappas | |
| 4,064,719 | A | 12/1977 | Boeckman et al. | |
| 4,101,153 | A | 7/1978 | Dozier | |
| 4,223,943 | A * | 9/1980 | VanHulle | B60J 7/194 292/337 |
| 4,268,076 | A | 5/1981 | Itoi | |
| 4,290,634 | A | 9/1981 | Gelhard | |
| 4,312,528 | A | 1/1982 | Hall et al. | |
| 4,389,061 | A | 6/1983 | Foshee | |
| 4,470,277 | A | 9/1984 | Uyeda | |
| 4,536,021 | A | 8/1985 | Mochida | |
| 4,629,228 | A | 12/1986 | Marko et al. | |
| 4,634,155 | A | 1/1987 | Geringer et al. | |
| 4,639,025 | A * | 1/1987 | Fann | E05B 63/06 292/1 |
| 4,669,394 | A | 6/1987 | Fogleman et al. | |
| 4,679,834 | A | 7/1987 | Gotanda | |
| 4,688,492 | A | 8/1987 | Peghetti | |
| 4,714,282 | A | 12/1987 | Henderson | |
| 4,754,715 | A | 7/1988 | Squires | |
| 4,768,817 | A * | 9/1988 | Fann | E05B 63/06 292/1 |
| 5,040,652 | A | 8/1991 | Fish et al. | |
| 5,044,182 | A | 9/1991 | Totten | |
| 5,139,292 | A | 8/1992 | Beals | |
| 5,249,831 | A | 10/1993 | Maniaci | |
| 5,308,130 | A | 5/1994 | Lee | |
| 5,473,922 | A | 12/1995 | Bair et al. | |
| 5,487,289 | A | 1/1996 | Otto, III et al. | |
| 5,495,733 | A | 3/1996 | Yen et al. | |
| 5,501,492 | A * | 3/1996 | Kajuch | E05B 53/00 292/1.5 |
| 5,516,160 | A * | 5/1996 | Kajuch | E05B 53/00 292/1.5 |
| 5,632,170 | A | 5/1997 | Evans | |
| 5,669,642 | A | 9/1997 | Kang | |
| 5,819,563 | A | 10/1998 | Bianco | |
| 5,862,692 | A | 1/1999 | Legault et al. | |
| 5,865,481 | A | 2/1999 | Buschmann | |
| 6,007,122 | A | 12/1999 | Linder et al. | |
| 6,070,923 | A | 6/2000 | Tanimoto et al. | |
| 6,565,134 | B1 | 5/2003 | Stuart et al. | |
| 6,575,508 | B2 | 6/2003 | Stuart et al. | |
| 6,622,534 | B1 | 9/2003 | Miller et al. | |
| 6,648,382 | B1 | 11/2003 | Monig et al. | |
| 6,709,033 | B2 | 3/2004 | Jooss et al. | |
| 6,746,060 | B2 * | 6/2004 | O'Brien, II | E05B 65/1046 292/337 |
| 7,007,524 | B2 | 3/2006 | Jasper | |
| 7,424,814 | B2 | 9/2008 | Jasper | |
| 7,464,570 | B1 * | 12/2008 | Chen | E05B 43/005 109/59 R |
| 2006/0032418 | A1 * | 2/2006 | Smith | E05B 47/0603 109/59 R |

FOREIGN PATENT DOCUMENTS

| | | |
|---|---|---|
| FR | 817076 | 8/1937 |
| GB | 10530 | 7/1888 |
| GB | 2039983 | 8/1980 |

* cited by examiner

DEAD BOLT LOCK SYSTEM AND METHOD OF RETRACTING A DEAD BOLT

FIELD OF THE INVENTION

The invention relates generally to dead bolt locks and, more particularly, to dead bolt locks used on doors for accessing secure areas.

BACKGROUND OF THE INVENTION

The use of dead bolts for security purposes is widespread. One example of a high security dead bolt lock is shown in U.S. Pat. No. 7,007,524 (Lockmasters, Inc., Nicholasville, Ky.), the disclosure of which is incorporated herein by reference. Another example of these types of dead bolt mechanisms is shown in U.S. Pat. No. 7,424,814 (Lockmasters, Inc.), the disclosure of which is also incorporated by reference herein. These systems include various mechanisms that prevent retraction of the dead bolt, including a typical lock with a lock bolt and at least one electronic, internal access control that may be actuated by entering correct code or credential. These systems include a handle on the outside of the door that is operable to retract the dead bolt provided that the lock and access member(s) are unlocked. These systems may or may not include a life safety feature in the form of an escape lever that allows a user to retract the dead bolt from an inside of the door regardless of the status of the lock and/or the access control mechanism(s). Moreover, these systems include several security features that thwart unwanted entry, such as a night latch lock down mechanism that disables the internal mechanisms responsible for retracting the dead bolt when the outside handle is actuated. Additionally, several mechanical features are provided that block internal dead bolt retraction mechanisms in case the system is tampered with.

Despite the success of these systems, there are drawbacks associated with these systems and other prior art in the lock industry. The complicated designs of the multiple security features lend themselves to complicated assembly and re-assembly after, for example, a relock mechanism has been triggered, whether accidentally or after a thwarted attempt. The use of the lock down mechanism adds to the complication of the design and prevents the use of a panic bar on the inside of the door. Moreover, malfunctioning of the lock down mechanism may prevent the escape lever from functioning. And, because the override mechanism is configured to override each of the lock and access member(s), there is a risk that, if the override key is obtained by an unwanted person, access to the secure area is very likely to occur.

Moreover, there is no indication to a user on the inside of the door whether the dead bolt is in an extended or retracted position. This may be problematic because it is possible that an authorized person trying to gain access to the secure area may arrange to have the deadbolt blocked from re-extending upon closing of the door. Such blocking may be completed in many ways, such as by inserting an object into or disabling a certain structure in the system to prevent the passage or movement of the dead bolt once the door closes. In an ordinary door, a person may be able to view whether the dead bolt is extended by viewing the space between an edge of the door and the doorjamb. However, in high security environments, a space between the door jamb and door may not be visible due to sound sealing insulation or other materials or structure, making it impossible to see whether the dead bolt is in the extended or retracted position. These systems include dead bolt hold back mechanisms that prevent the dead bolt from extending when the door is open. Moreover, because the escape lever is operative to retract the dead bolt upon actuation of the escape lever, opening the door from the inside with the escape lever or from the outside with the handle to check the status of the dead bolt will not provide an indication of tampering.

In view of these and other challenges in this area of the lock industry, a need has developed to provide an improved dead bolt lock system.

SUMMARY OF THE INVENTION

In one embodiment, a dead bolt lock system for use on a door is provided and includes a housing structure adapted to be mounted on an inside of the door. A dead bolt is mounted in the housing for movement between extended and retracted positions. A slider member is movable between first and second positions and operatively coupled to the dead bolt such that when the slider member is in the first position, the dead bolt is in the extended position, and when the slider member is in the second position, the dead bolt is in the retracted position. A first movable member is positioned in a path of movement of the slider member and configured to be displaced by the slider member to thereby allow the slider member to move to the second position. A first lock has a first condition preventing the displacement of the first movable member and a second condition allowing the displacement of the first movable member. A second lock has a first condition preventing the displacement of the first movable member and a second condition allowing the displacement of the first movable member. The slider member is movable along a plane and the first movable member is positioned to intersect the plane before being displaced by the slider member and to no longer intersect the plane after being displaced by the slider member.

In another embodiment, a dead bolt lock system for use on a door is provided and includes a housing structure adapted to be mounted on an inside of the door. A dead bolt is mounted in the housing for movement between extended and retracted positions. A first lock and a second lock each have locked and unlocked conditions and are operatively connected with the dead bolt. The first and second locks are independently controlled by the input of correct unlocking information to allow movement of the dead bolt from the extended position to the retracting position. A dead bolt retracting structure is operatively connected to the dead bolt such that when at least one of the first or second locks is in the locked condition, operation of the retraction structure is prevented thereby preventing retraction of the dead bolt. When both of the first and second locks are in an unlocked condition, at least a portion of the retracting structure is operative to allow retraction of the dead bolt. An override mechanism is configured to bypass only one of the first or second locks such that the lock that is not bypassed by the override mechanism must be in the unlocked condition for retracting structure to retract the dead bolt.

In yet another embodiment, a dead bolt lock system for use on a door is provided and includes a housing structure adapted to be mounted on an inside of the door. A dead bolt is mounted in the housing for movement between extended retracted positions. A lock is coupled with the dead bolt. A dead bolt retracting structure is operatively connected to the dead bolt such that when the lock is unlocked, at least a portion of the retracting structure is operative to allow retraction of the dead bolt. When the lock is locked, operation of the dead bolt retracting structure is prevented, thereby preventing retraction of the dead bolt. A bearing is mounted in the housing adjacent to the dead bolt and configured to reduce a force required to retract and extend the dead bolt.

In yet another embodiment, a dead bolt lock system for use on a door is provided and includes a housing structure adapted to be mounted on an inside of the door. A dead bolt is mounted in the housing for movement between extended and retracted positions. A lock is coupled with the dead bolt and controlled by the input of correct unlocking information to allow movement of the dead bolt from the extended position to the retracted position. A dead bolt retracting structure is operatively connected to the dead bolt such that when the lock is unlocked, at least a portion of the retracting structure is operative to allow retraction of the dead bolt. When the lock is locked, operation of the dead bolt retracting structure is prevented, thereby preventing retraction of the dead bolt. The system includes an escape lever including a movable arm interacting with the dead bolt retracting structure to retract the dead bolt when the lock is in the locked condition and when the lock is in the unlocked condition. The escape lever extends generally from the housing structure and is operable to retract the dead bolt with at least one of a pushing motion in a first direction, whereby the movable arm moves to a first position relative to the retracting structure, or a pulling motion in a second direction whereby the movable arm moves to a second position relative to the retracting structure.

In yet another embodiment, a dead bolt lock system for use on a door is provided and includes a housing structure adapted to be mounted on an inside of the door. A dead bolt is mounted in the housing for movement between extended and retracted positions. A lock is coupled with the dead bolt and controlled by the input of correct unlocking information to allow movement of the dead bolt from the extended position to the retracted position. A dead bolt retracting structure is operatively connected to the dead bolt such that when the lock is unlocked, at least a portion of the retracting structure is operative to allow retraction of the dead bolt. When the lock is locked, operation of the dead bolt retracting structure is prevented, thereby preventing retraction of the dead bolt. The system also includes an escape lever having a handle and a movable arm interacting with the dead bolt retracting structure. The escape lever is configured to retract the dead bolt when the lock is in the locked condition and when the lock is in the unlocked condition. The escape lever extends generally from the housing structure and is operable to retract the dead with at least one of a pushing motion in a first direction, whereby the handle moves to a first position relative to the door, or a pulling motion in a second direction whereby the handle moves to a second position relative to the door. The handle is configured to reside in the first position or second position upon a pushing motion or pulling motion, respectively, that results in retraction of the dead bolt, until the dead bolt is extended.

In yet another embodiment, a dead bolt lock system for use on a door is provided and includes a housing structure adapted to be mounted on an inside of the door. A dead bolt is mounted in the housing for movement between extended and retracted positions. A lock is coupled with the dead bolt and controlled by the input of correct unlocking information to allow movement of the dead bolt from the extended position to the retracted position. A dead bolt retracting structure is operatively connected to the dead bolt such that when the lock is unlocked, at least a portion of the retracting structure is operative to allow retraction of the dead bolt. When the lock is locked, operation of the dead bolt retracting structure is prevented, thereby preventing retraction of the dead bolt. The system also includes an escape lever including a movable arm interacting with the dead bolt retracting structure. The escape lever is configured to retract the dead bolt when the lock is in the locked condition and when the lock is in the unlocked condition. The escape lever extends generally from the housing structure and is operable to retract the dead bolt with at least one of a pushing motion in a first direction, or a pulling motion in a second direction. Upon the pushing motion or pulling motion, the movable arm is configured to move in an axial direction that is opposite of a direction of movement of the dead bolt as the dead bolt moves from the extended position to the retracted position.

In yet another alternative embodiment, a dead bolt lock system for use on a door is provided and includes a housing structure adapted to be mounted on an inside of the door. The system includes a dead bolt having a first slot and being mounted in the housing for movement along a plane and between extended and retracted positions. A lock is coupled with the dead bolt and controlled by the input of correct unlocking information to allow movement of the dead bolt from the extended position to the retracted position. The system also includes a slider member having a second slot and being movable between first and second positions along a plane. The slider member is operatively connected to the dead bolt such that when the slider member is in the first position, the dead bolt is in the extended position, and when the slider member is in the second position, the dead bolt is in the retracted position. The system also includes a dead bolt retracting structure having a body and first and second arms extending from the body in a direction generally transverse to the plane. The first arm is configured to be received in the first slot. The second arm is configured to be received in the second slot, thereby operatively connecting the slider member and the dead bolt.

In yet another embodiment, a dead bolt lock system for use on a door is provided and includes a housing structure adapted to be mounted on an inside of the door. The system includes a dead bolt having a first slot including a front portion and a rear portion. The dead bolt is mounted in the housing for movement between extended and retracted positions. A lock is coupled with the dead bolt and controlled by the input of correct unlocking information to allow movement of the dead bolt from the extended position to the retracted position. The system also includes a dead bolt retracting structure including a first arm received in the first slot and movable from a first position whereby the first arm is positioned at or near the front of the first slot to a second position whereby the first arm engages the rear portion of the first slot to thereby retract the dead bolt. A force blocking structure is connected to the dead bolt and configured to prevent retraction of the dead bolt due to a force applied to an outer end of the dead bolt. The force blocking structure is inwardly biased towards a center of the dead bolt. The force blocking structure is blocked from moving inwardly by the first arm when the first arm is in the first position and is allowed to move inwardly when the first arm is in the second position.

In yet another embodiment, a method of retracting a dead bolt of a dead bolt lock system is provided. The system includes the dead bolt operatively coupled to a slider member. The slider member is movable between a first position whereby the dead bolt is in an extended position and a second position whereby the dead bolt is in a retracted position. The system also includes a first movable member positioned in a path of movement of the slider member and prevented from being displaced by first and second locks in a locked condition. The method includes unlocking the first lock and the second lock and moving the slider member along a plane from the first position to the second position, whereby the first movable member is displaced out of the path of movement of the slider member such that the first movable member no longer intersects the plane after being displaced.

In yet another embodiment, a method of retracting a dead bolt of a dead bolt lock system is provided. The system includes the dead bolt, a first lock and a second lock, each having locked and unlocked conditions. The first and second locks are operatively connected with the dead bolt. The system further includes a dead bolt retracting structure operatively connected to the dead bolt such that when at least one of the first or second locks is in the locked position, operation of the retracting structure is prevented thereby preventing retracting of the dead bolt. When both the first and second locks are in an unlocked position, at least a portion of the retracting structure is operative to allow retraction of the dead bolt. The system further includes an override mechanism configured to bypass only one of the first and second locks. The method includes unlocking one of the first or second locks and operating the override mechanism such that the other of the first or second locks is bypassed to thereby allow the operation of the retracting structure and thus retraction of the dead bolt regardless of the locked or unlocked condition of the lock being bypassed.

In yet another embodiment, a method of retracting a dead bolt of a dead bolt lock system is provided. The system includes the dead bolt and a lock coupled with the dead bolt and controlled by the input of correct unlocking information to allow movement of the dead bolt from an extended position to a retracted position. The system also includes a dead bolt retracting structure operatively connected to the dead bolt, and an escape lever including a movable arm interacting with the dead bolt retracting structure to retract the dead bolt. The method includes actuating the escape lever to operate the retracting structure and thereby retract the dead bolt regardless of whether the lock is locked or unlocked. When a pushing motion in a first direction is used to actuate the escape lever, the movable arm moves to a first position relative to the retracting structure. When a pulling motion in a second direction is used to actuate the escape lever, the movable arm moves to a second position relative to the retracting structure.

In yet another embodiment, a method of retracting a dead bolt of a dead bolt lock system associated with a door is provided. The system includes the dead bolt and a lock coupled with the dead bolt and controlled by the input of correct unlocking information to allow movement of the dead bolt from an extended position to a retracted position. The system also includes a dead bolt retracting structure operatively connected to the dead bolt, and an escape lever. The escape lever includes a movable arm interacting with the dead bolt retracting structure to retract the dead bolt. The escape lever has a neutral position where the dead bolt is in the extended position, an inward position where the dead bolt is in the retracted position, and an outward position where the dead bolt is in the retracted position. The method includes actuating the escape lever to operate the retracting structure to thereby retract the dead bolt regardless of whether the lock is locked or unlocked. When a pushing motion in a first direction is used to actuate the escape lever, the escape lever remains in the inward position until the dead bolt moves back to the extended position. When a pulling motion in a second direction is used to actuate the escape lever, the escape lever remains in the outward position until the deadbolt moves back to the extended position.

In yet another embodiment, a method of retracting a dead bolt of a dead bolt lock system is provided. The system includes a dead bolt and a lock coupled with the dead bolt and controlled by the input of correct unlocking information to allow movement of the dead bolt from an extended position to a retracted position. The system also includes a dead bolt retracting structure operatively connected to the dead bolt, and an escape lever. The escape lever includes a movable arm interacting with the dead bolt retracting structure to retract the dead bolt. The method includes actuating the escape lever to operate the retracting structure and thereby retract the dead bolt regardless of whether the lock is locked or unlocked. The movable arm moves in an axial direction that is opposite of a direction of movement of the dead bolt as the dead bolt moves from the extended to the retracted position.

In yet another embodiment, a method of retracting a dead bolt of a dead bolt lock system is provided. The system includes the dead bolt having a first slot including a front portion and a rear portion, and a lock coupled with the dead bolt. The system also includes a dead bolt retracting structure including a first arm received in the first slot at the front portion thereof when the retracting structure is in a first position and the dead bolt is in an extended position. The system also includes a force blocking structure connected to the dead bolt configured to prevent retraction of the dead bolt due to a force applied to an outer end of the dead bolt. The force blocking structure is inwardly biased towards a center of the dead bolt. The method includes operating the retracting structure such that the first arm moves towards and engages the rear of the first slot to thereby retract the dead bolt, wherein the force blocking structure moves inwardly to engage the first arm in order to prevent the retracting structure from moving back to the first position.

DETAILED DESCRIPTION OF THE DRAWINGS

General Organization and Operation

Figure 1:
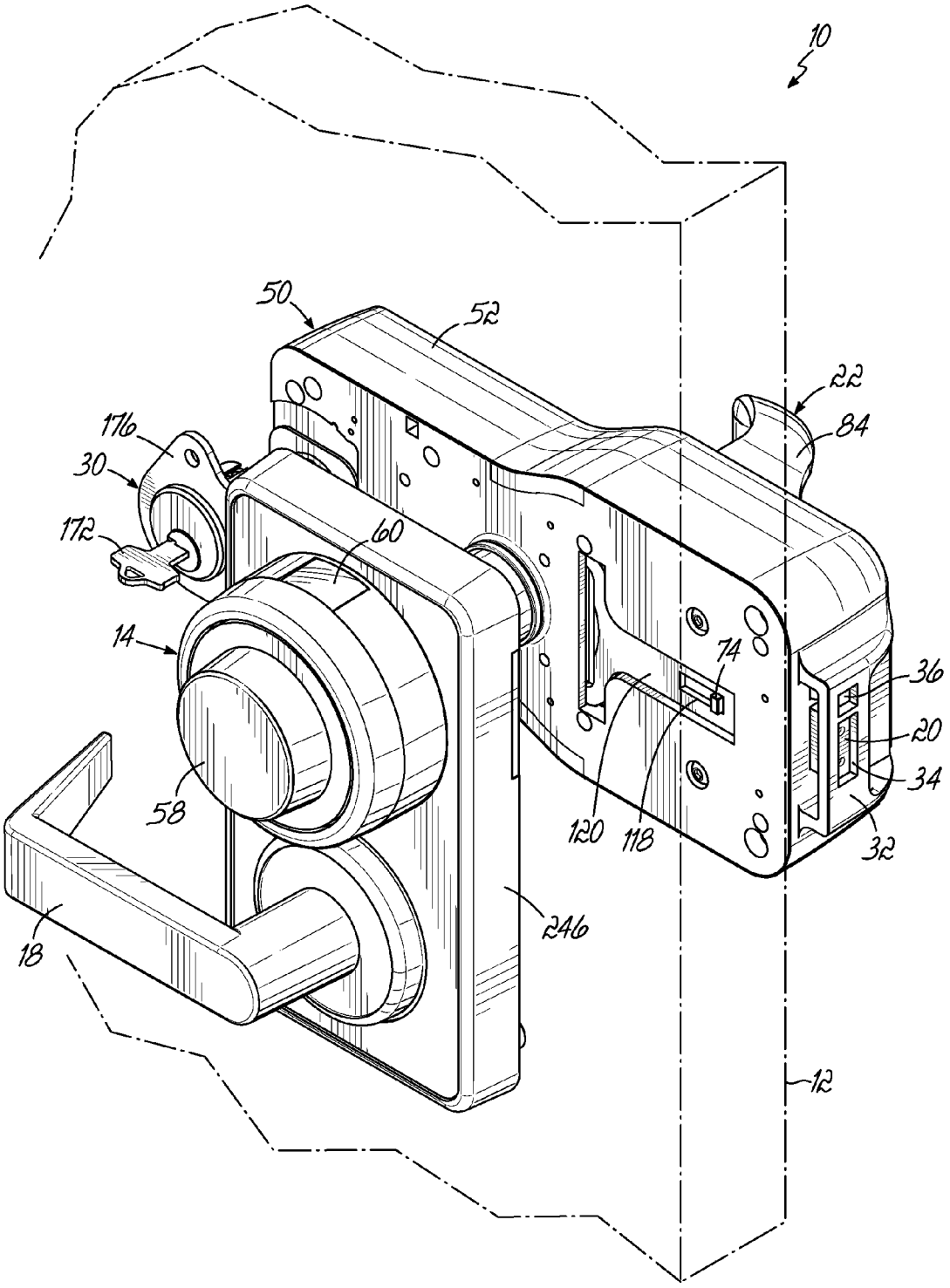
FIG. 1 is a front perspective view of one embodiment of the invention showing the dead bolt lock system components from the outside of a door.
Figure 2:
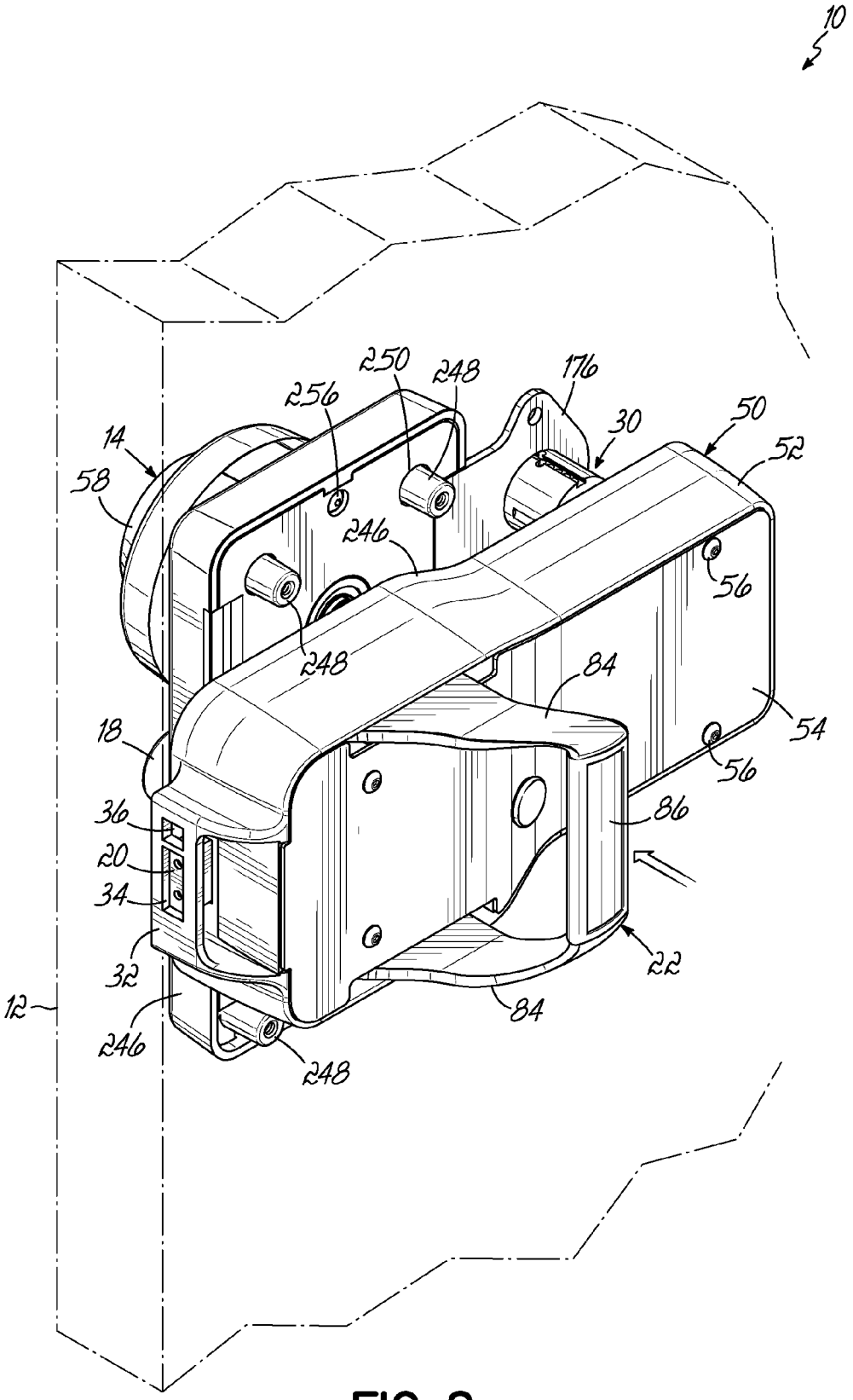
FIG. 2 is a rear perspective view of the lock system shown in FIG. 1, showing the components as viewed from the inside of the door.

Referring generally to FIGS. 1-4, a dead bolt lock system 10 constructed in accordance with one preferred embodiment of the invention is shown attached to a door 12 (shown in phantom). Lock system 10 includes a primary lock 14, which may be a high security or lower security electric combination lock, and secondary lock or access control 16. A door handle or lever 18 disposed on the outside of door 12 is shown connected just below primary lock 14. Once lock 14 has been unlocked by a user by inputting correct unlocking information, and access control 16 has been successfully actuated by a user, the door handle 18 may be rotated up or down to withdraw, or retract, a dead bolt 20, in a manner to be described, to gain access to a secure area behind door 12. System 10 further includes an escape lever 22, the actuation of which is operative to retract the dead bolt 20 regardless of the locked or unlocked conditions of either lock or access control 16.

Access control 16 as shown is operable by the input of electronic information, such as information from an electronic key pad, magnetic card strip, RFID reader, or the like (not shown), that is then received by circuit board assembly 25. Circuit board assembly 25 is operative to send a signal to access control 16 to thereby actuate motor 26, which causes the movement of blocker member 27 along a threaded rod 28 from a first, locked position where it blocks or impedes the movement of certain structures to prevent the retraction of dead bolt 20, to a second, unlocked position where it allows the movement of certain structures to thereby allow the retraction of dead bolt 20.

Figure 12A:
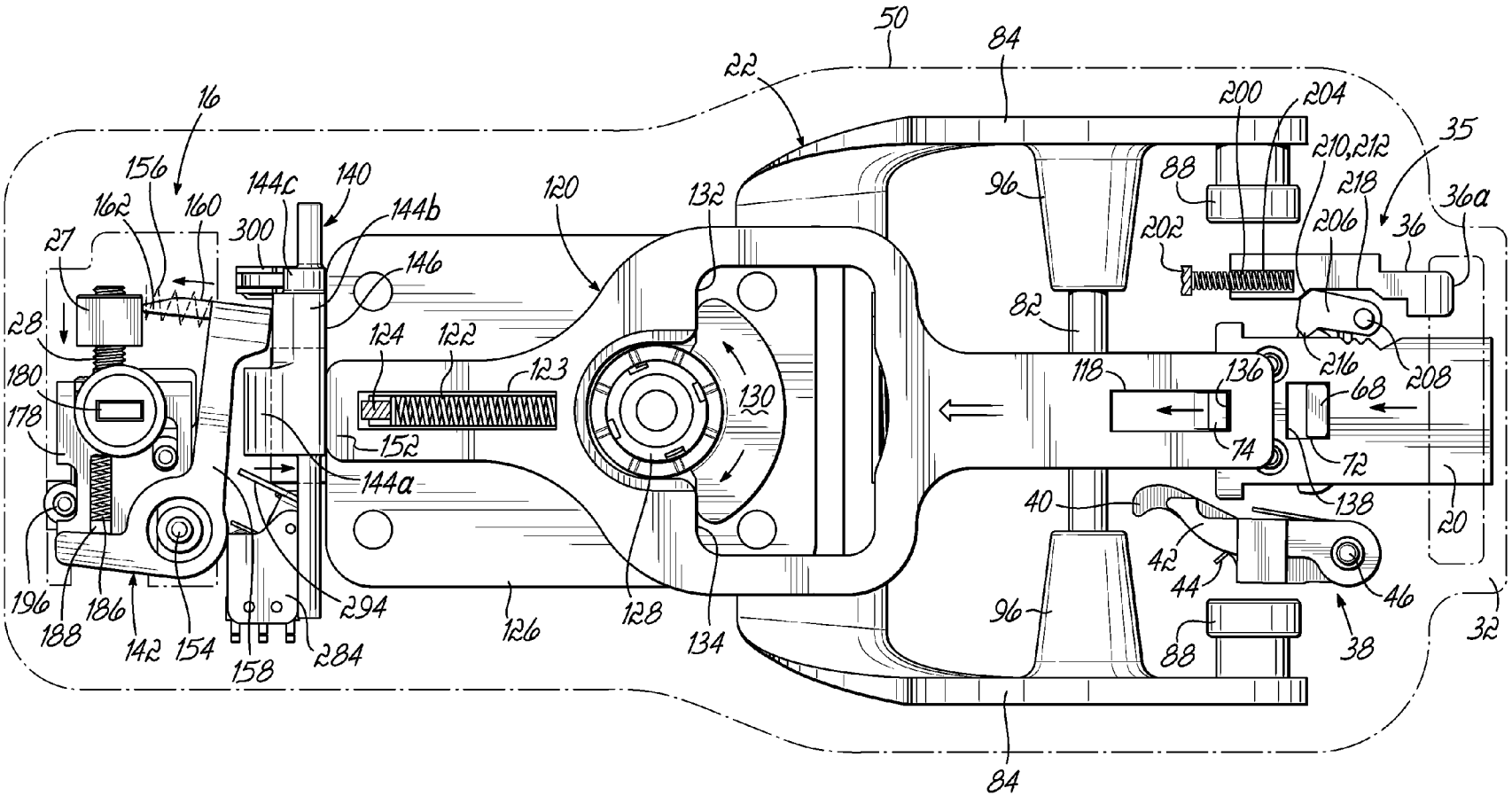
FIG. 12A shows a front view of certain components of the system of FIG. 1, associated with retracting and extending the dead bolt, with the dead bolt in an extended position.
Figure 14:
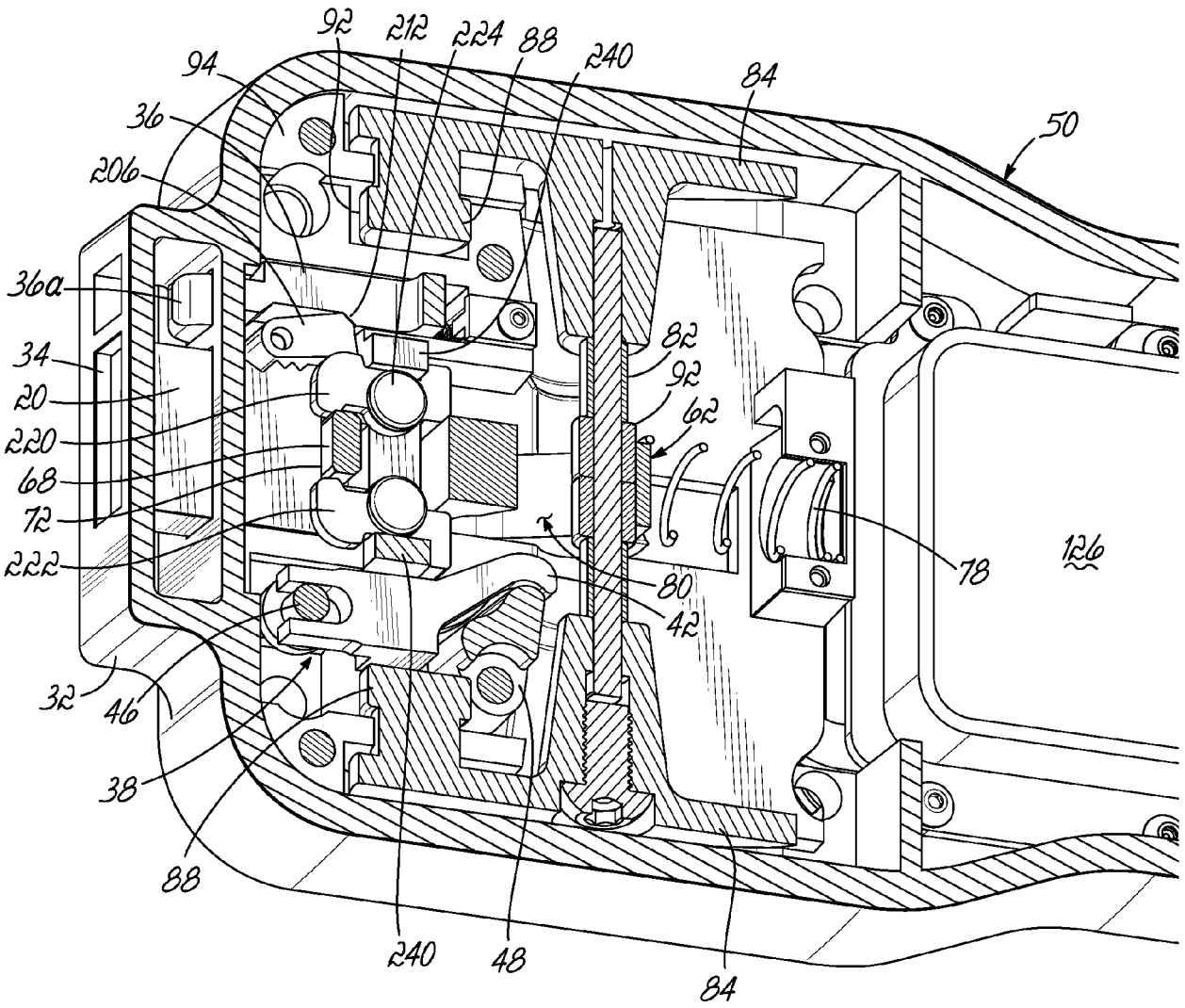
FIG. 14 is a rear perspective view, in partial cross-section, of the system of FIG. 1 showing certain internal components.
Figure 15:
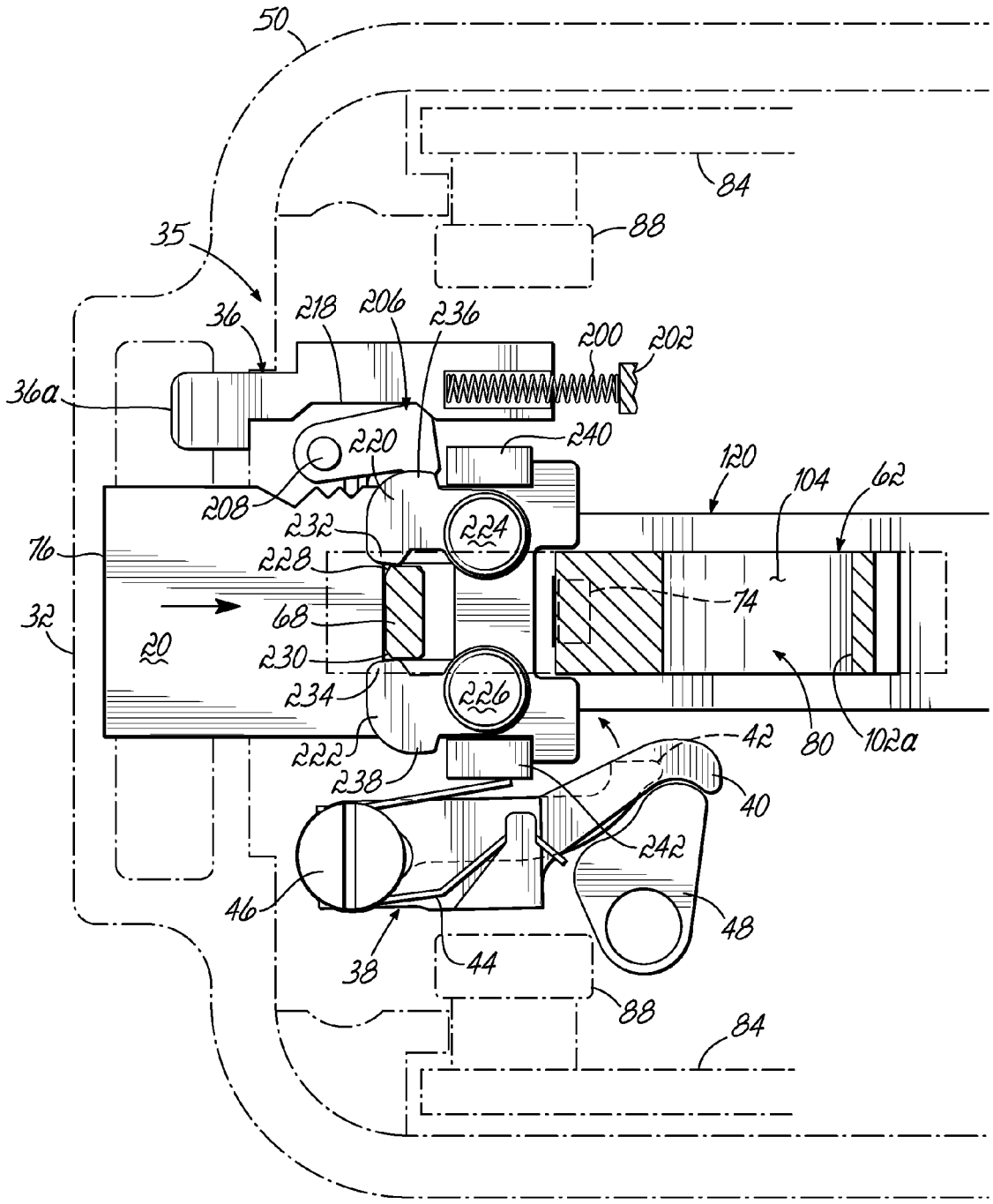
FIG. 15 is a rear view of the system of FIG. 1, showing certain components in partial cross-section.
Figure 16:
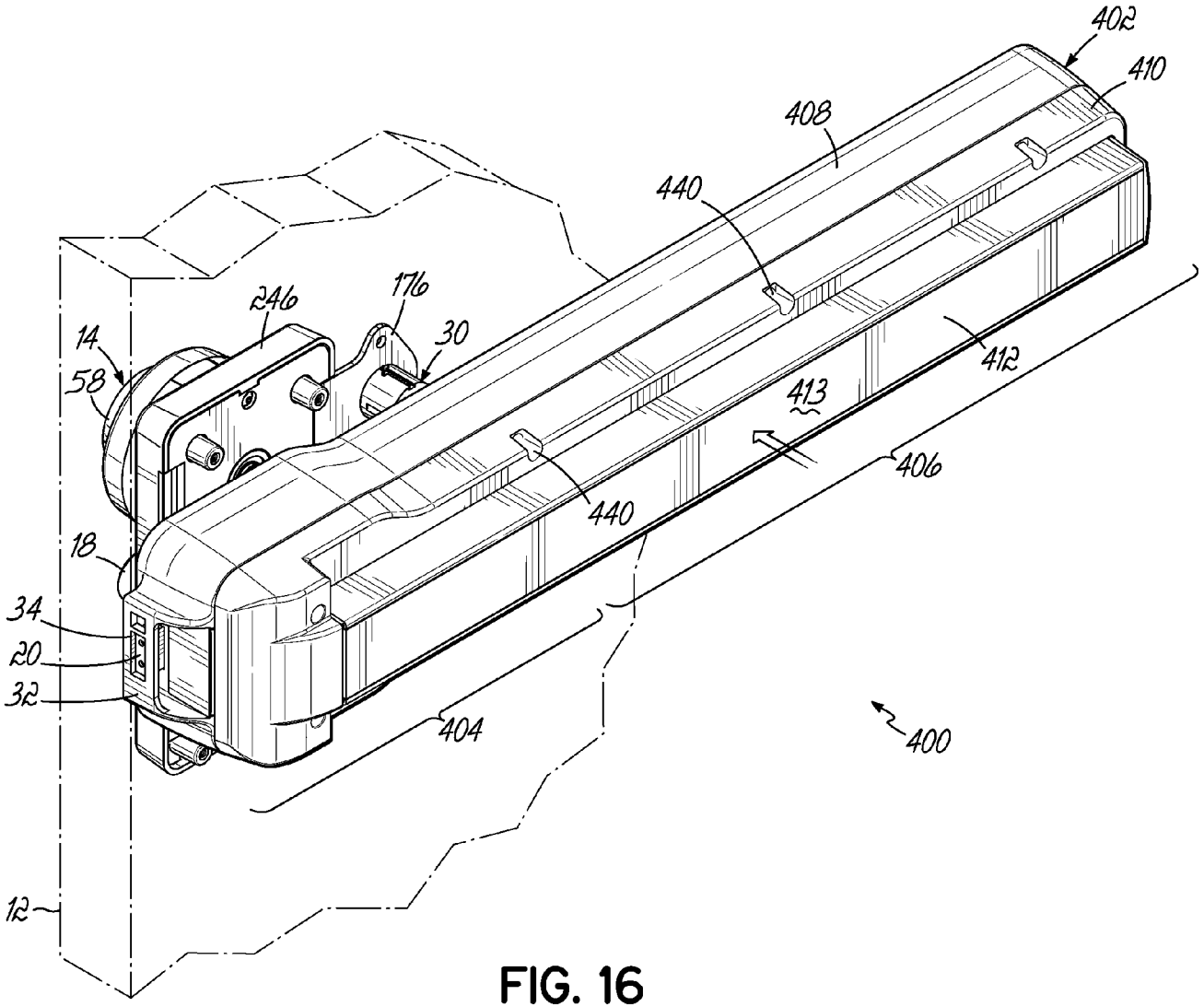
FIG. 16 is a rear perspective view of an alternative embodiment of the invention, including a panic bar.
Figure 17:
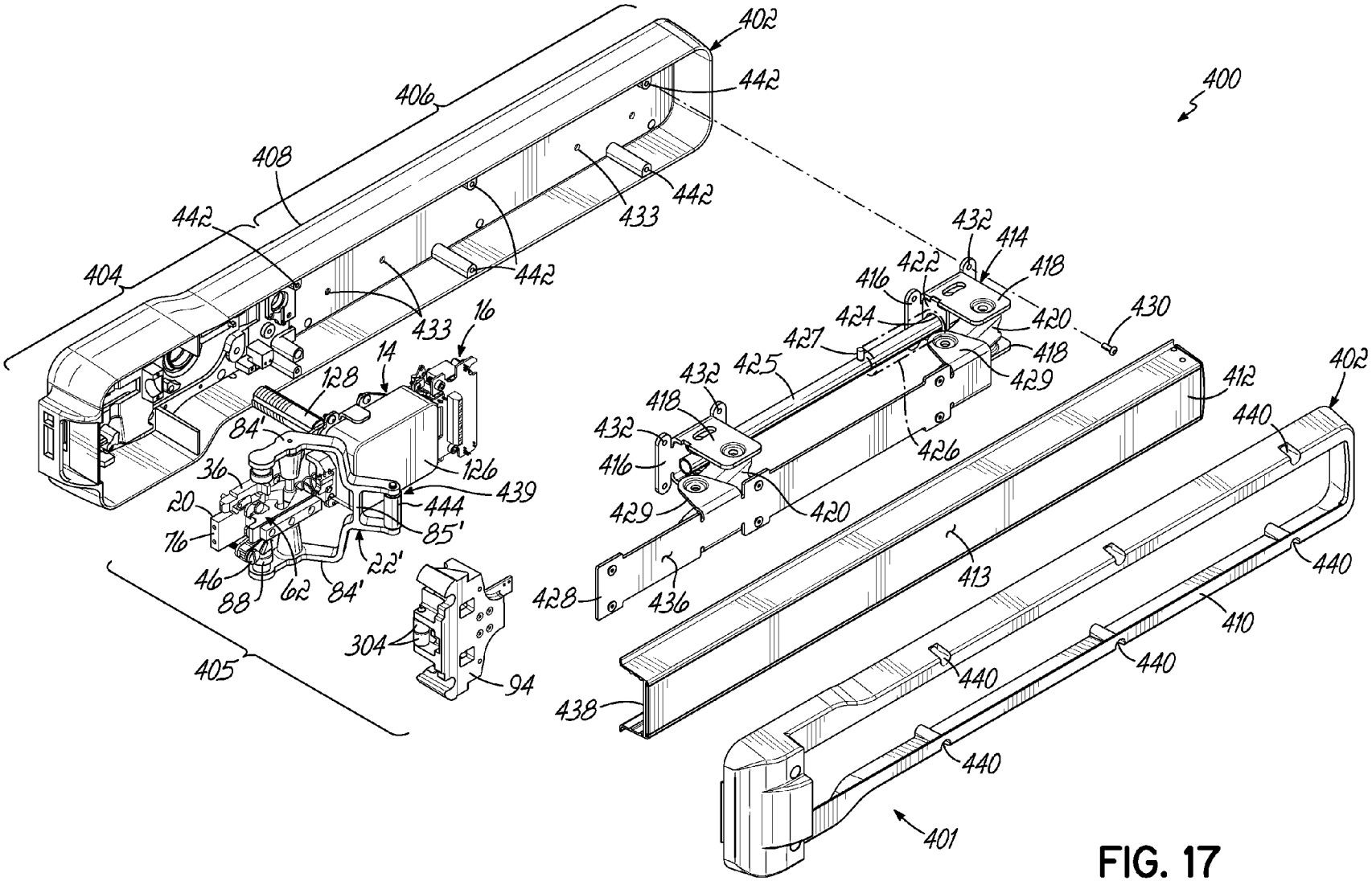
FIG. 17 is a rear exploded perspective view of the system of FIG. 17.

It will be appreciated that access control 16 may also be considered a "lock" for purposes of this dead bolt system 10, in that it has a similar function to a lock. Lock system 10 further includes an override 30 that, when properly actuated, bypasses one of the locks, as described in more detail below. Dead bolt 20 is shown to be extendible and retractable within a bail 32 and bail 32 is adapted to receive a strike plate (not shown), as will be described below. Dead bolt 20 extends into a recess or hole 34 contained in a wall of bail 32 to prevent access to the end of dead bolt 20 during a forced entry attempt. As shown best in FIGS. 6A-B and 12A-C, a dead bolt hold back mechanism 35 including a trigger member 36 is provided adjacent dead bolt 20 and assists in maintaining dead bolt 20 in a retracted position when system 10 is unlocked, and automatically extends dead bolt 20 when door is shut, as described below. Dead bolt hold back mechanism 35 functions in a substantially similar manner to that described in U.S. Pat. No. 7,007,524, at column 14, lines 14 to 50, which is incorporated herein by reference. As described in more detail below, dead bolt lock system 10 also includes escape lever 22 that operates to retract dead bolt 20 regardless of the locked or unlocked condition of any other feature in lock system 10, except the inertia assembly 38 (FIGS. 6A, 14A), which is substantially similar to the inertia assembly 38 described in U.S. Pat. No. 7,242,814, at column 18, line 7 to column 21, line 27. Alternatively, the inertia assembly 38 herein may be configured to be substantially similar to the inertia assembly 38 described in U.S. Pat. No. 7,007,524 at column 17, lines 10 to 52, which is incorporated herein by reference. As described in these disclosures, and shown best in FIGS. 12A-C, the inertia assembly 38 generally includes an actuator weight 40 for providing a body having sufficient inertia to reset movement during application of a shock load, a bolt lock lever 42 coupled to the actuator weight 40 for restraining the dead bolt 20, a return spring 44 for biasing the inertia assembly 38 towards a neutral position enabling the dead bolt 20 to retract, a stud 46 for coupling the actuator weight 40, the bolt lock lever 42, and the return spring 44 together and to the housing, and a curved post 48 (FIG. 14) for facilitating the rotation of the actuator weight 40 during the application of the shock load.

A single housing 50 encloses components of lock 14 and internal mechanical and electrical components of access control 16. Housing 50 further contains actuating structure for dead bolt 20, as well as various other features to be described. As shown, housing 50 is essentially one structure including shroud 52 and back cover 54, which are connected with fasteners 56. There are several support structures within the housing 50 that support or are associated with certain structures. However, it will be appreciated that housing 50 may be divided into multiple housings or other lock support structures. Lock 14 is specifically shown as a combination lock, such as disclosed in U.S. Pat. No. 6,064,923, using a dial 58 and an LCD display 60 for displaying combination numerals. It will be appreciated that many different types of locks may be substituted for lock 14 and access control 16.

Figure 4:
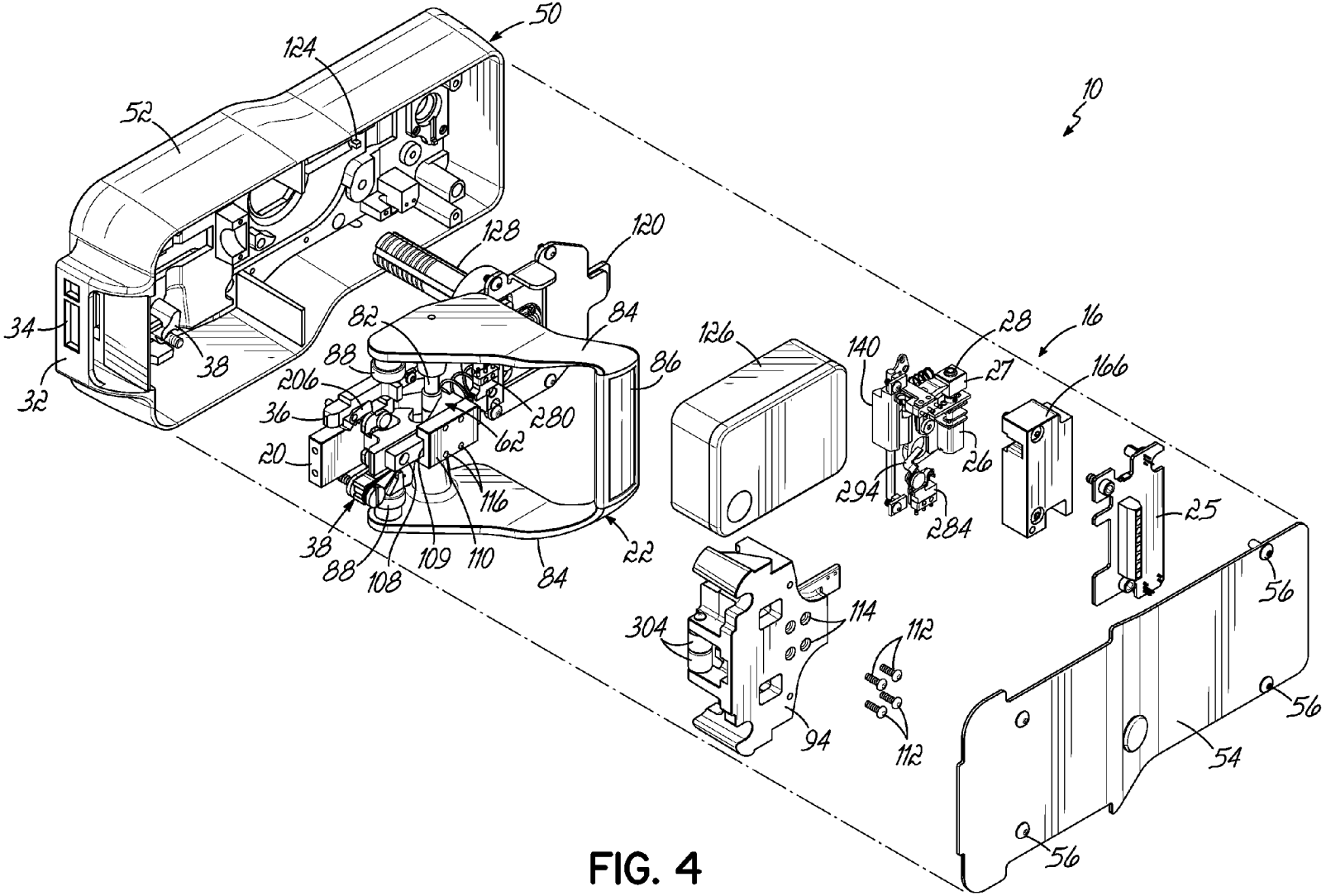
FIG. 4 is another rear perspective exploded view of the system of FIG. 1.
Figure 5A:
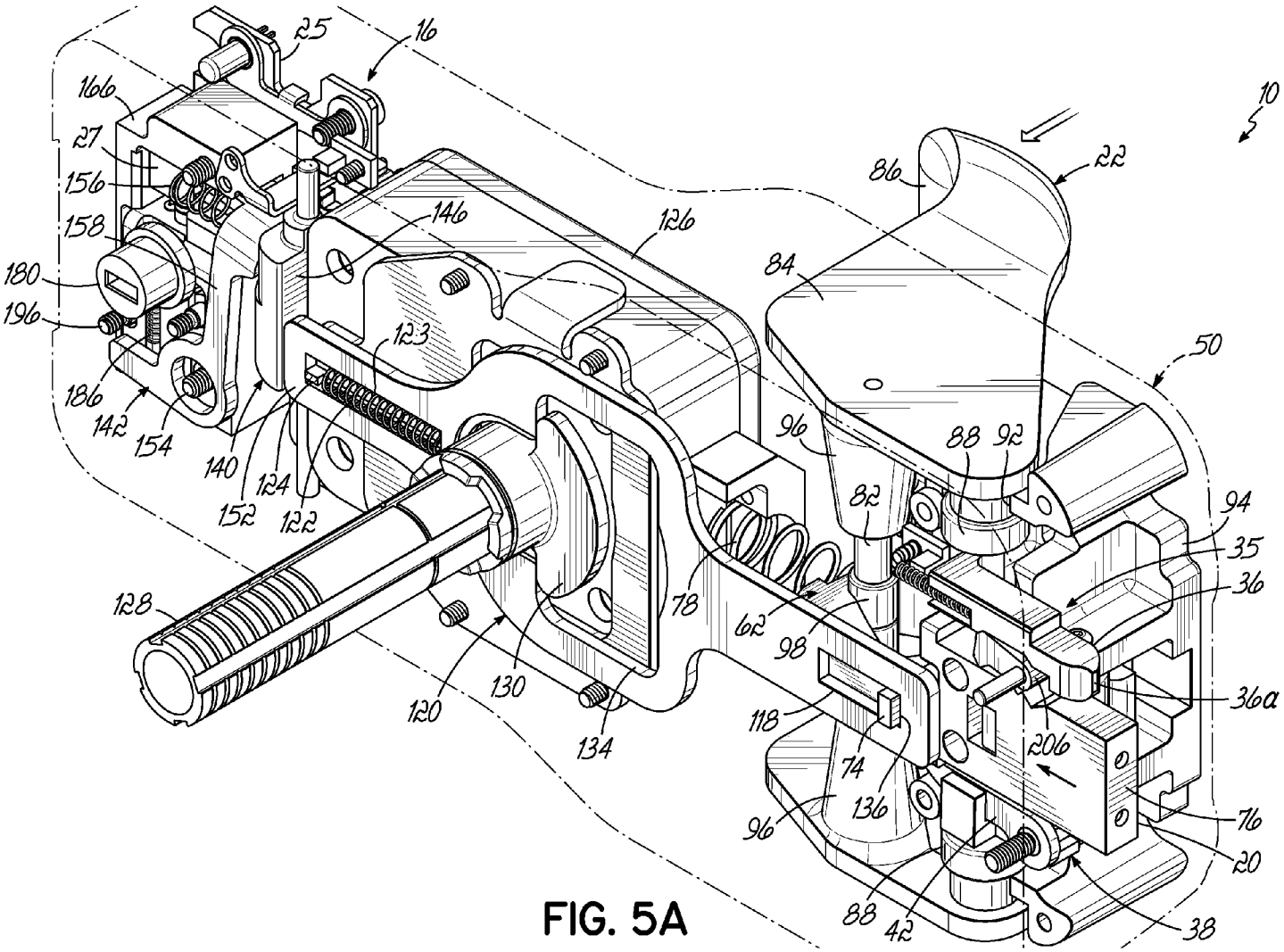
FIG. 5A is front perspective view of the system showing a dead bolt in an extended position.
Figure 5B:
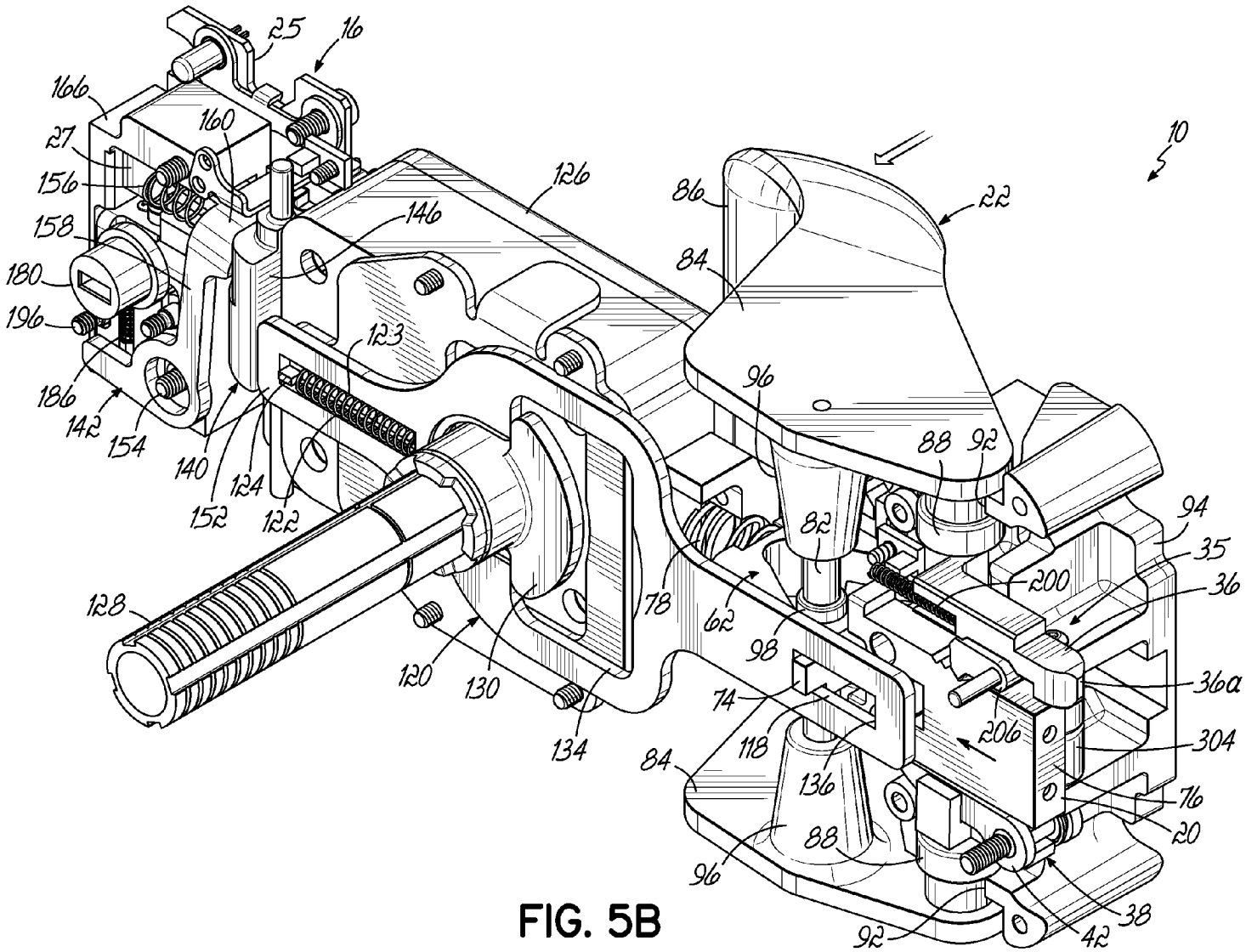
FIG. 5B is a front perspective view of the system of FIG. 1 showing the dead bolt in a retracted position by actuation of an escape lever.
Figure 6A:
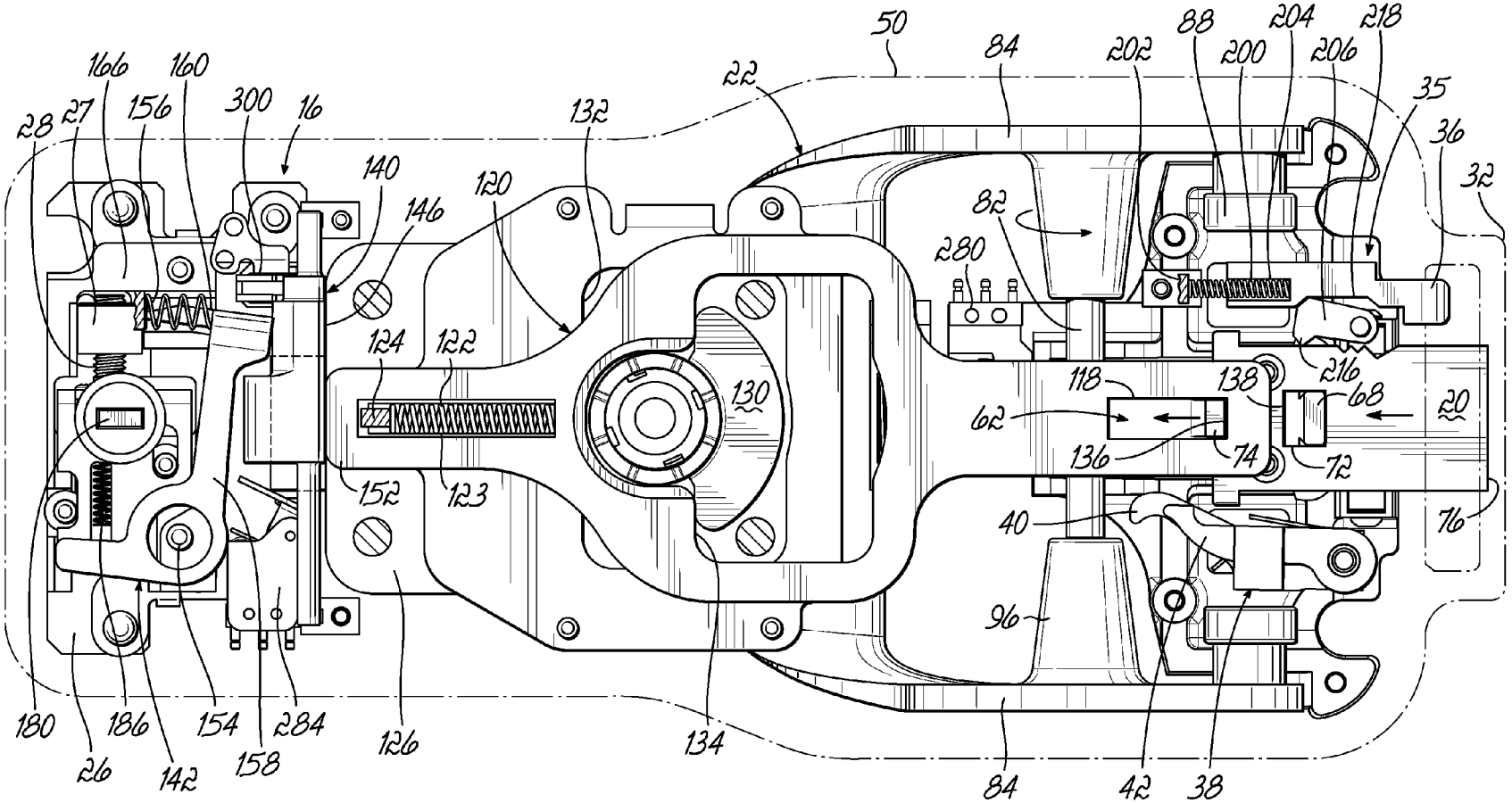
FIG. 6A is a front view of the system of FIG. 1, showing the dead bolt in an extended position.
Figure 6B:
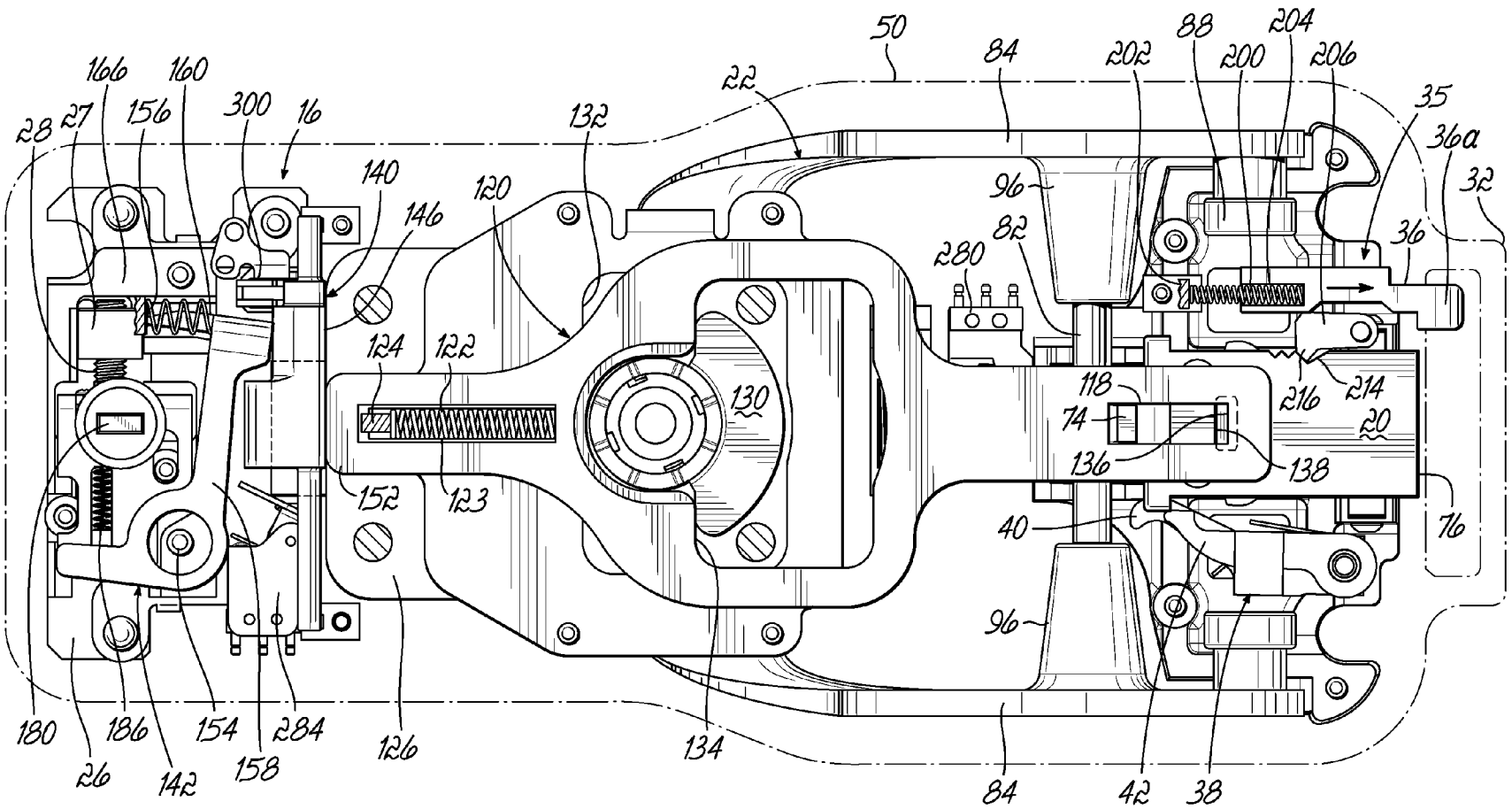
FIG. 6B is a front view of the system of FIG. 1 showing the dead bolt in a retracted position by actuation of the escape lever.
Figure 7A:
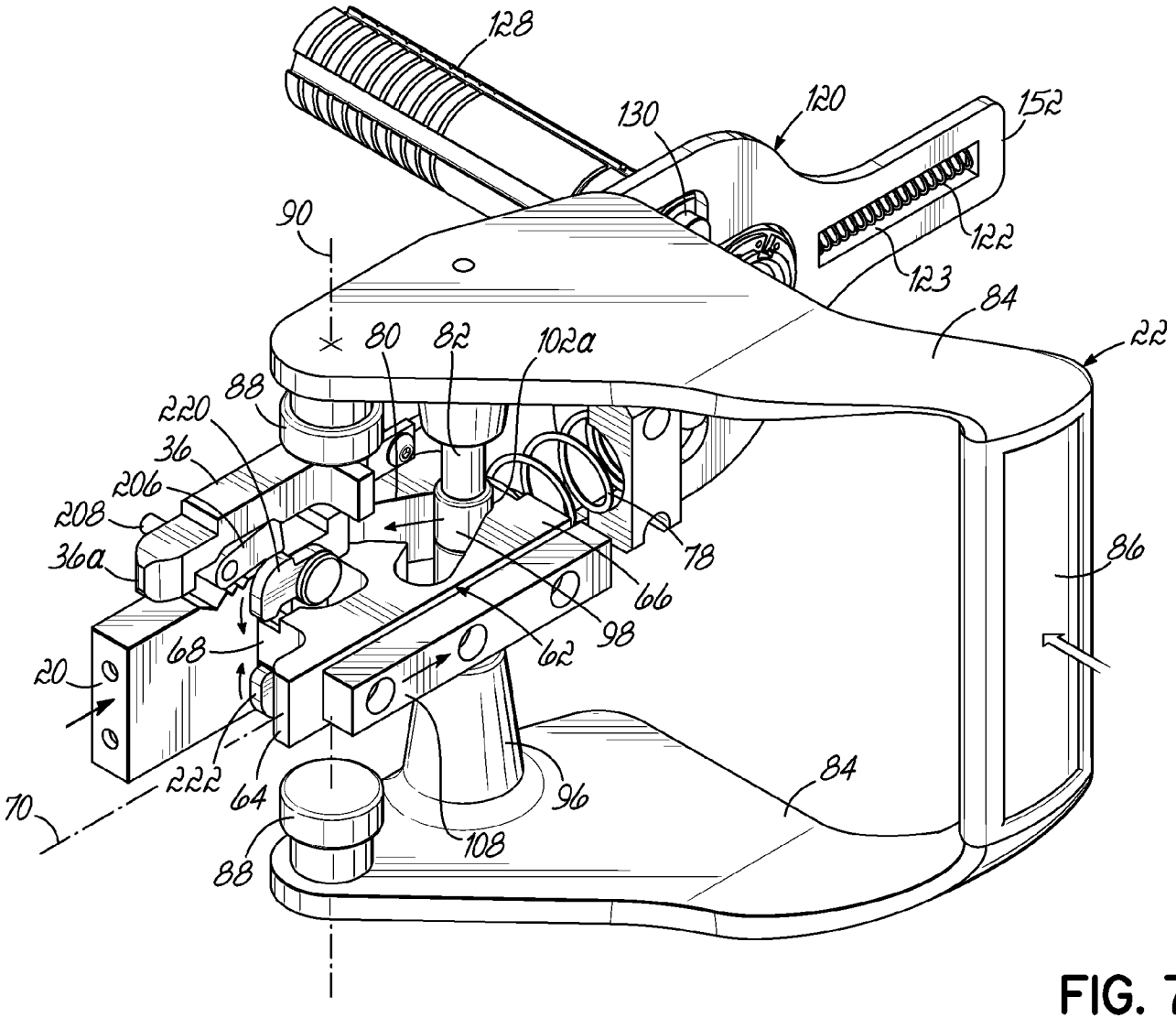
FIG. 7A is a rear perspective view of certain components of the system of FIG. 1, showing the dead bolt in an extended position.
Figure 7B:
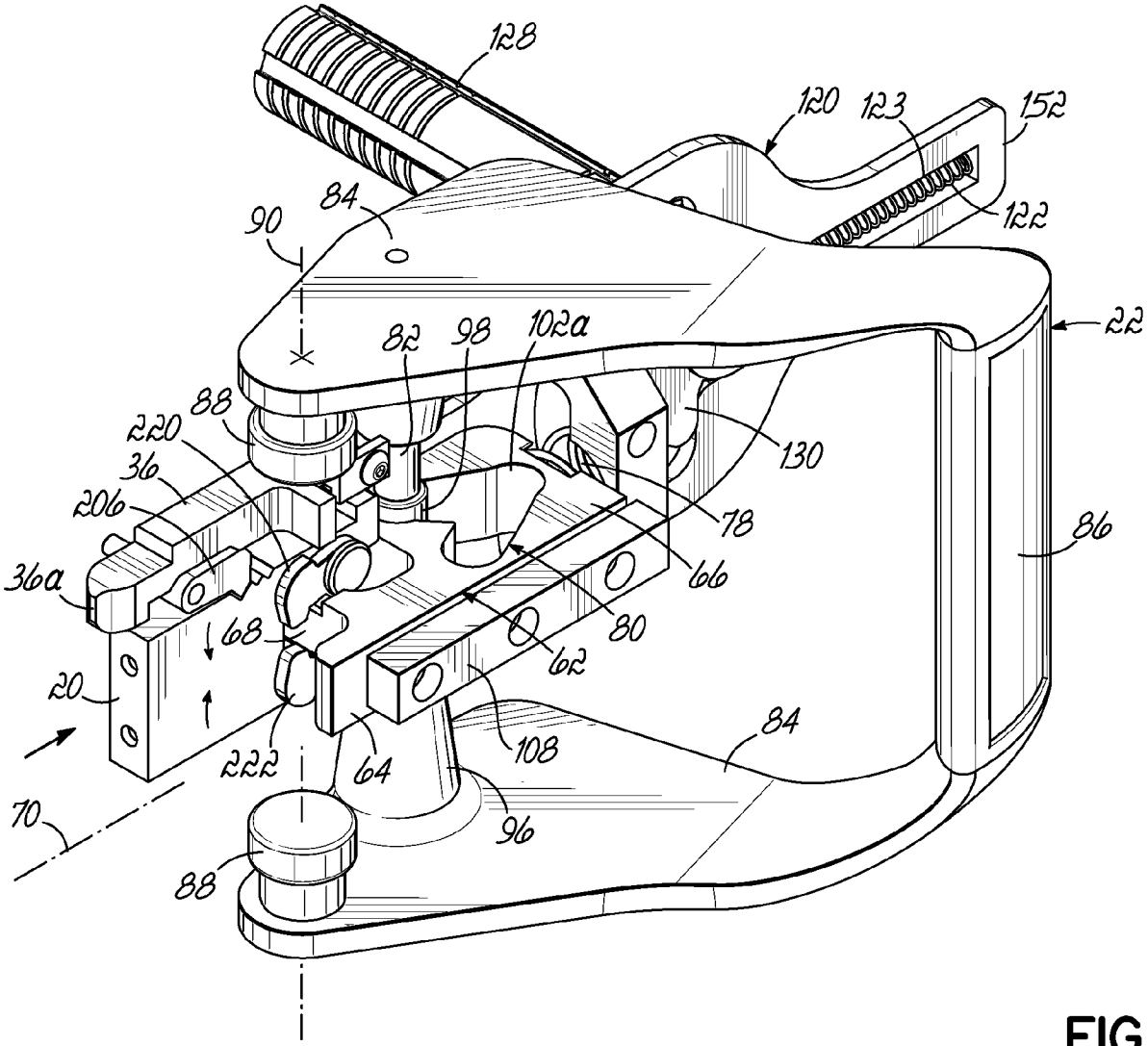
FIG. 7B is a rear perspective view of certain components of the system of FIG. 1, showing the dead bolt in a retracted position due to actuation of the escape lever.

A general understanding of the main components used to extend and retract dead bolt 20 using may be gained from a review of FIGS. 5A-B, 6A-B, and 7A-B. FIGS. 5A, 6A, and 7A respectively show dead bolt 20 in an extended position, while FIGS. 5B, 6B, and 7B respectively show dead bolt 20 in a retracted position. Dead bolt retracting structure 62 is operatively coupled to dead bolt 20 to facilitate the extension and retraction of the dead bolt 20. Retracting structure 62 includes a body having a first end 64 and a second end 66. The first end 64 includes first arm 68 extending downwardly from the body transversely, and preferably perpendicularly, relative to an axis 70 along which the body of the retracting structure 62 generally extends. The first arm 68 is positioned for sliding movement within a slot 72 in dead bolt 20. A second arm 74 extends downwardly from the body transversely, and preferably perpendicularly, relative to axis 70 such at least a portion of the each of the first and second arms 68, 74 are parallel to one another. Moreover, the first and second arms 68, 74 are positioned relative to one another that the first arm 68 is forward of the second arm 74, such that the first arm 68 is closer to a front portion 76 (FIG. 4) of the dead bolt 20. The first and second arms are positioned such that at least a portion of each is coaxial with an axis along which the slider member moves, as discussed below. When the system 10 is assembled, second arm 74 interacts with a slider member or draw bar 120 during the rotation of handle 18 in order to retract the dead bolt 20, as described in further detail below.

The second end 66 of retracting structure 62 bears against a spring 78 which, when the dead bolt 20 is extended, is in a relaxed position and, when the dead bolt 20 is retracted, is in a compressed position. In other words, spring 78 biases the member, and thus the dead bolt 20, towards the extended position in order to facilitate extension of the dead bolt 20 provided that the trigger member 36 allows the dead bolt 20 to extend, as described herein.

The dead bolt retracting structure 62 further includes a cam aperture 80 that interacts with components of the escape lever 22 in order to be actuated to thereby retract and/or extend the dead bolt 20. Thus, when either the escape lever 22 on the inside of door 12 is actuated, or when handle 18 on outside of door 12 is actuated, first arm 68 of retracting structure 62 interacts with the slot 72 of dead bolt 20 to cause the rearward movement of retracting structure 62 and thereby retracts the dead bolt 20, provided that certain other conditions are met. Similarly, the forward movement of the retracting structure 62 is operative to extend dead bolt 20, provided that certain conditions are met.

FIGS. 5A-B, 6A-B, 7A-B, and 8A-B show the operation of the escape lever 22 and the interaction between components of the escape lever 22 and the retracting structure 62 that are operative to retract and extend the dead bolt 20. As mentioned above, the escape lever 22 is operative to retract dead bolt 20 regardless of the locked or unlocked condition of any other feature in lock system 10, except the inertia blocker member 38. The main component actuated by escape lever 22 is a movable arm 82 positioned essentially between a pair of side arms 84. Escape lever 22 includes a handle 86 between side arms 84, each of which are able to move as pivots 88 rotate about axis 90 (FIG. 7A) in a space formed by a recess 92 (FIG. 14) in casting 94 and a recess (not shown) in housing 50. Movable arm 82 is a generally cylindrical, elongated member and includes generally frustroconical members 96 at each end thereof connecting it to the handle 86. The frustroconical members 96 are provided, at least in part, to impart robustness to the movable arm 82. Movable arm 82 also includes rollers 98 that are rotatably mounted relative to the movable arm 82 on a center portion of the movable arm 82. The rollers 98 are configured to interact with the cam aperture 80 in order to retract retracting structure 62, and thus the dead bolt 20, as the handle 86 is actuated.

As the handle 86 is actuated, rollers 98 must overcome the force from one of the first or second ridges 100*a*, 100*b* of cam aperture notch 102*a* to exit from the cam aperture notch 102*a*, depending on whether the escape lever 22 is pushed or pulled. Once the rollers 98 exit from the cam aperture notch 102*a*, the rollers 98 cam against either a first cam portion 104 or a second cam portion 106 of the aperture 80 to move the retracting structure 62 in the rearward direction, thus retracting the dead bolt 20. As the retracting structure 62 moves, slider bearing 108 (which is coupled to retracting structure 62 via fasteners 108*a*) (FIG. 8A) bears against bearing slot 109 (FIG. 4) of bearing slot member 110 (FIG. 4), which is fixed to the casing 94 by fasteners 112 extending through bores 114 of casing 94 and bores 116 of bearing slot member 110. Depending on whether the escape lever 22 is pushed such that the handle 86 moves inwardly towards the door 12, or pulled such that the handle 86 moves away from the door 12, the movable arm 82 occupies different positions relative to the retracting structure 62. Moreover, when the escape lever 22 is subjected to either a pushing motion or pulling motion, the movable arm 82 is configured to move in an axial direction that is opposite of a direction of movement of the dead bolt 20 as the dead bolt 20 moves from the extended position to the retracted position. For example, as viewed from FIG. 8A-C, the movable arm 82 moves to the left when the escape lever 22 is either pushed or pulled, which thereby causes the retraction of the dead bolt 20 to the right.

With particular reference to FIGS. 5A-B, 7A-C, and 8A-B, when escape lever 22 is pushed, movable arm 82, and more specifically, rollers 98 of movable arm 82 must overcome the force from first ridge 100*a* to exit from cam notch 102*a*. After movable arm 82 has exited from cam notch 102*a*, rollers 98 are able to cam against first cam portion 104 of retracting structure 62 and into second cam notch 102*b* to move the retracting structure 62 in a rearward direction. Because the retracting structure 62 is essentially fixed in the vertical direction such that movement thereof in the vertical direction is prevented, the camming action between the movable arm 82 and the first cam portion 104 causes a rearward axial movement of the retracting structure 62. To this end, the angle of the first cam portion 104 relative to the plane of movement of the retracting structure 62, and thus the angle of movement of the movable arm 82 as rollers 98 cam against the first cam portion 104, is selected such that at least a rearward force is provided when the handle 86 is actuated to move the retracting structure 62 in a rearward direction. Such an angle may be between approximately 20 degrees and approximately 30 degrees.

Figure 8A:
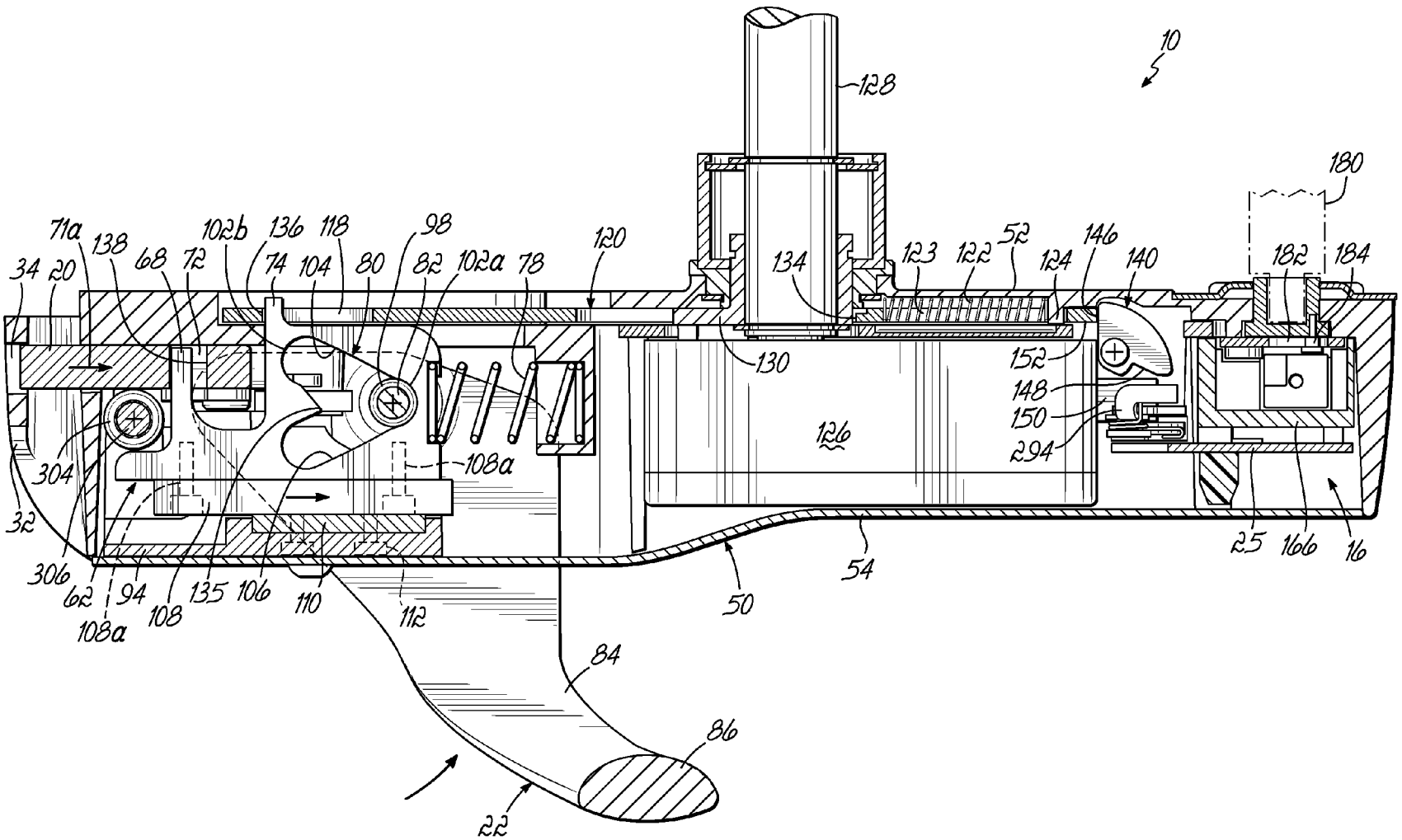
FIG. 8A is a top cross-sectional view of the system of FIG. 1 showing the dead bolt in an extended position.
Figure 8B:
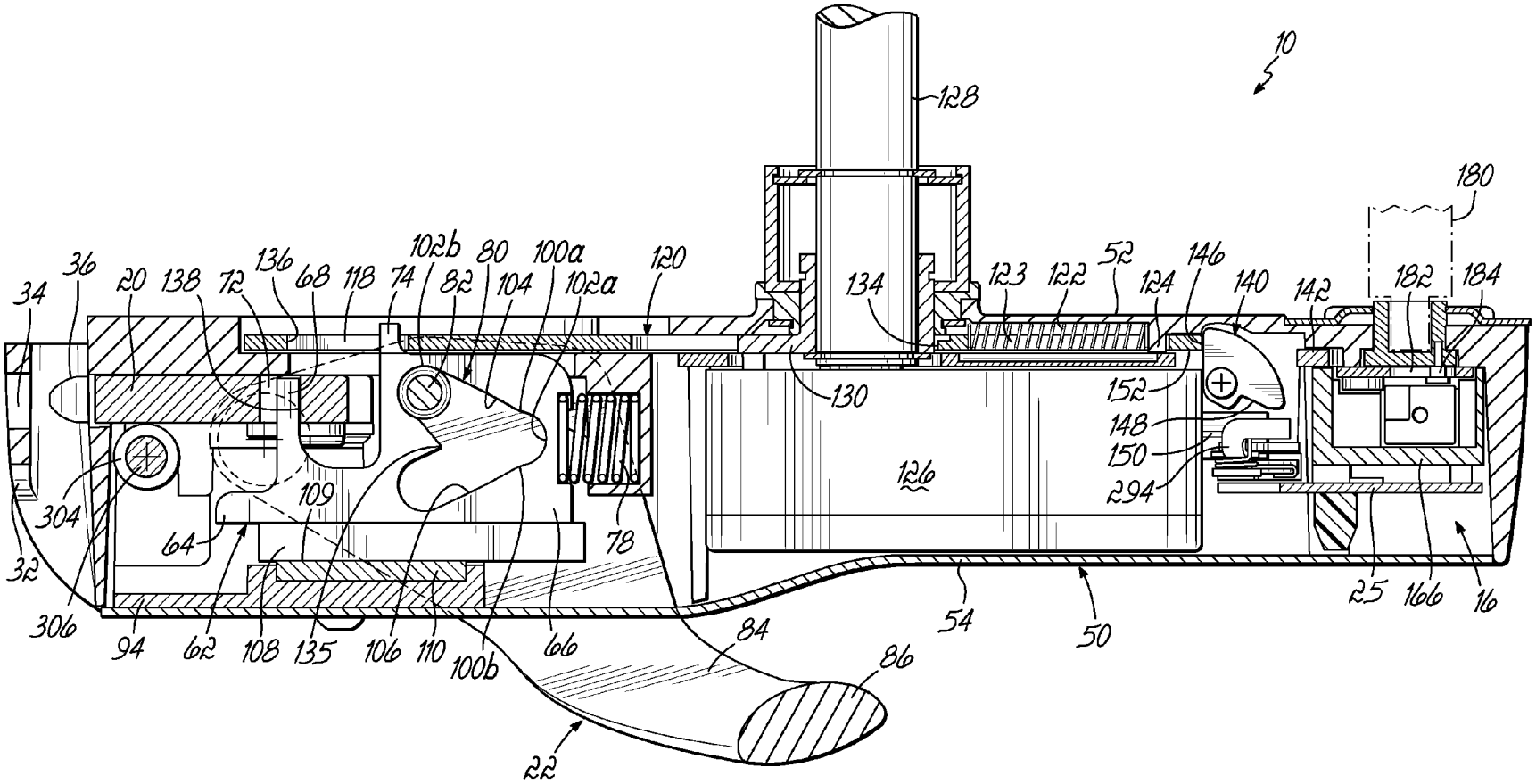
FIG. 8B is a top cross-sectional view of the system of FIG. 1 showing the dead bolt in a retracted position due to a pushing motion of the escape lever.
Figure 8C:
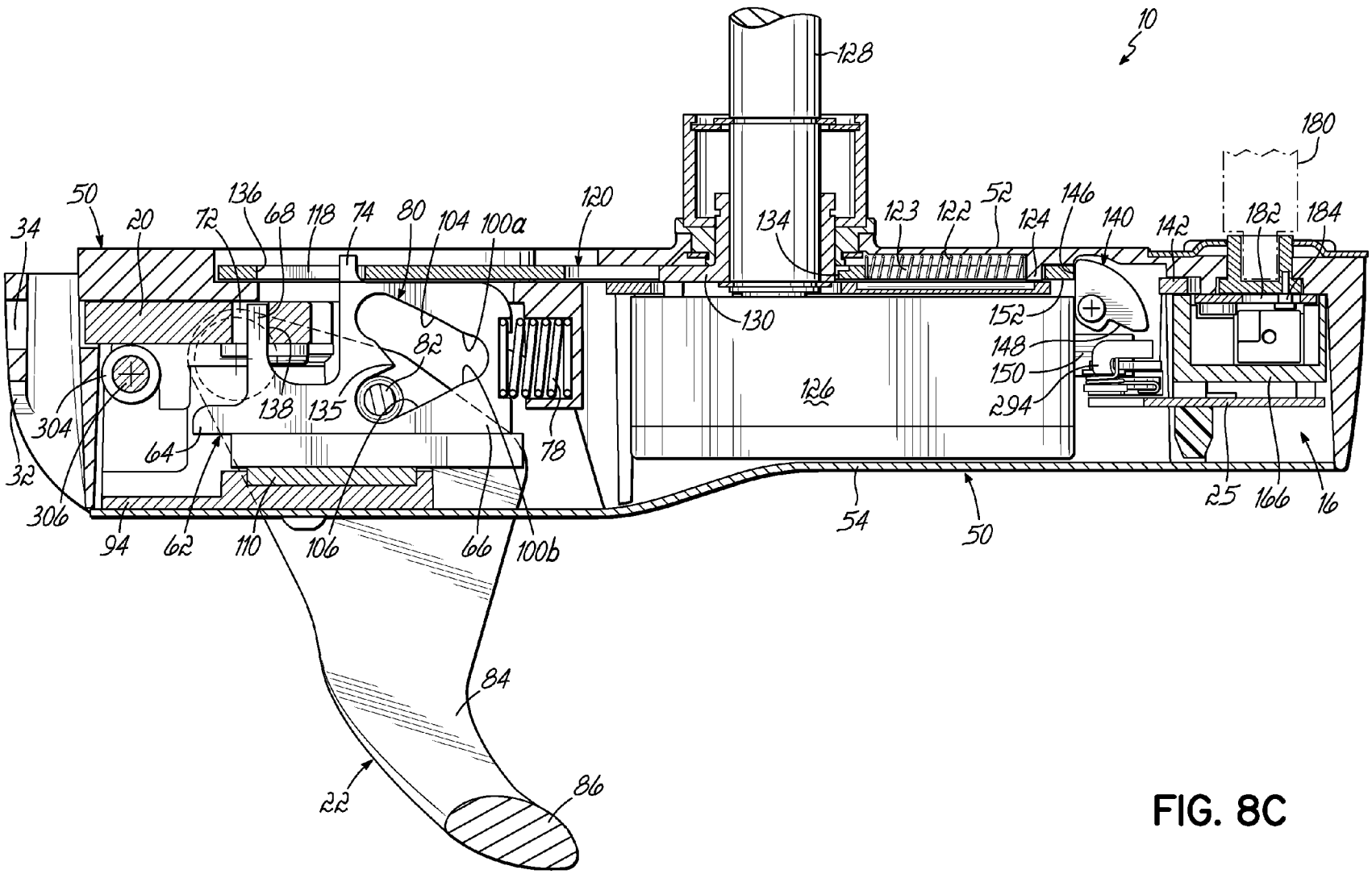
FIG. 8C is a top cross-sectional view of the system of FIG. 1 showing the dead bolt in a retracted position due to a pulling motion of the escape lever.

With reference to FIGS. 8A and 8C, when escape lever 22 is pulled, rollers 98 of movable arm 82 must overcome the force from second ridge 100*b* so that movable arm 82 may exit from cam notch 102*a*. Once movable arm 82 has exited from cam notch 102, rollers 98 are able to cam against the second cam portion 106, and movable arm 82 moves to a second position relative to the retracting structure 62. As before, because the retracting structure 62 is essentially fixed such that movement thereof in the vertical direction is prevented, the camming action between the rollers 98 and the second cam portion 106 causes a rearward axial movement of the retracting structure 62 to thereby retract the dead bolt 20. Moreover, the angle of the second cam portion 106 relative to the plane of movement of the retracting structure 62, and thus the angle of movement of the movable arm 82 as it cams against the first cam portion 104, is selected such that at least a rearward force is provided when the handle 86 is actuated to thereby move the retracting structure 62 in a rearward direction. Such an angle may be between approximately 20 degrees and approximately 30 degrees.

As the retracting structure 62 moves in the rearward direction, second arm 74 of retracting structure 62 traverses slot 118 of draw bar 120. Slot 118 is positioned and sized such that movement of the retracting structure 62 during actuation of the escape lever 22 does not cause movement of the draw bar 120. This configuration ensures that the mechanisms in place to prevent retraction of the draw bar 120 and thus retraction of the dead bolt 20, as described below, do not prevent retraction of the dead bolt 20 upon actuation of the escape lever 22.

With reference to FIGS. 9, 10A-B, and 11A-B, draw bar 120, also referred to herein as slider member, is operatively coupled between dead bolt retracting structure 62 and door handle 18. A spring 122 is provided to normally bias draw bar 120 toward dead bolt 20, as will be discussed herein. Spring 122 is contained within slot 123 (FIGS. 8A-C and 13A-C) in draw bar 120 and against a stop surface or post 124 connected with shroud 52 (FIG. 8C). A shaft 128 operatively coupled for rotation with door handle 18 (FIG. 1), in a manner to be described, is connected to a cam 130. Thus, when shaft 128 rotates in either direction, cam 130 engages either surface 132 or surface 134 of draw bar 120 to move or retract draw bar 120 to the right (as viewed in FIGS. 10A-B). Specifically, when draw bar 120 is moved to the right as viewed in FIGS. 10A-B, an end 136 of slot 118 will pull against second arm 74 of the retracting structure 62 and thereby draw retracting structure 62 to the right as first arm 68 engages the rear end 138 (FIGS. 6A, 8A-B, and 9) of slot 72 of dead bolt 20, which causes the retraction of dead bolt 20. As retracting structure 62 is retracted, movable arm 82 leaves cam notch 102*a* and contacts a contact portion 135 of the cam aperture 80. Specifically, rollers 98 of movable arm 82 contact the contact portion 135, which biases or directs the movable arm 82 towards cam notch 102*b*. Thus, as the draw bar 120 retracts further and essentially pulls the retracting structure 62 further, movable arm 82 moves into engagement with the second cam notch 102*b* and the escape lever 22 moves to the inward position, as described above. Notably, as described herein, the position of the draw bar 120 before retracting the deadbolt may be referred to herein as the first position or extended position, while the position of the draw bar after the dead bolt 20 has been retracted may be referred to herein as the second position or retracted position.

As will be discussed herein, several conditions must be met in the preferred embodiment for the above described retraction of dead bolt 20 to take place. Accordingly, the main conditions for retracting dead bolt with door handle 18 in the general manner are that lock 14 and access control 16 must be in unlocked conditions unless override mechanism 30 is utilized, as described below. System 10 includes first and second movable members 140, 142 that each interact with one another and at least one of the lock 14 or the access control 16 to selectively allow the retraction of the draw bar 120. The first movable member, also referred to herein as slider cam 140, normally resides in a first position (i.e., FIG. 8A) in a path of movement of the draw bar 120, and is configured to either remain in a first position to block the retraction of the draw bar 120, or be displaced by the draw bar 120 from the first position to a second position allowing retraction of the draw bar 120, depending on which conditions are present. When both lock 14 and access control 16 are in unlocked conditions, slider cam 140 is permitted to move to the second position (FIG. 9) such that retraction of the draw bar 120 is permitted. In order to move the lock 14 from the locked to the unlocked position, correct unlocking information must be input into the lock 14. For example, a correct combination must be put into dial 58. Preferably, once the lock bolt 150 is retracted, the lock bolt 150 may be re-extended such that it is in the locked condition by simply turning the dial 58 in the direction towards the extended position (counterclockwise as viewed in FIG. 12A). Alternatively, the lock bolt 150 may be extended back to the locked condition upon the input of correct locking information, which, for example, may be the same or a different combination as the correct unlocking information.

Figure 9:
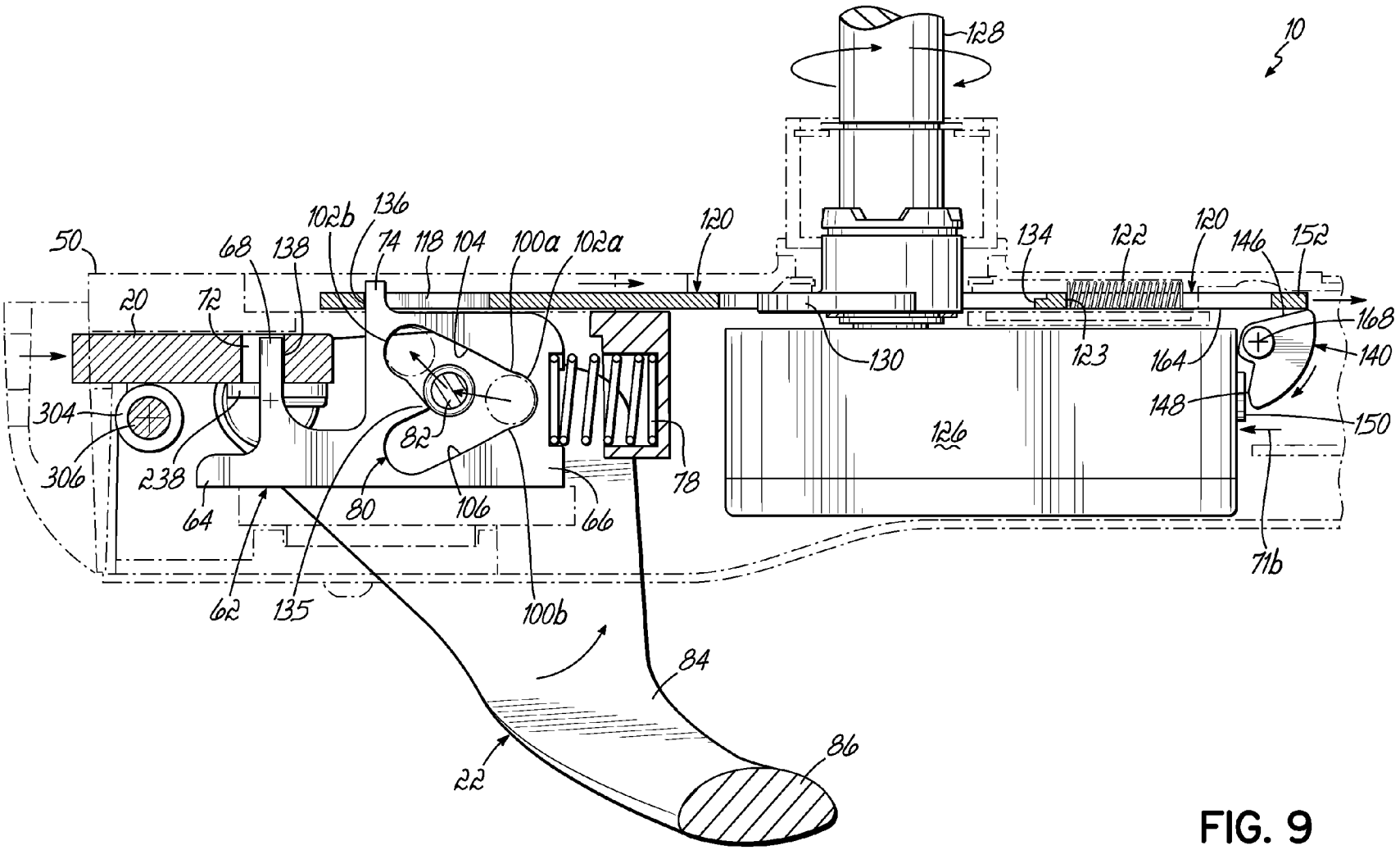
FIG. 9 is a top cross-sectional view of the system of FIG. 1 showing the dead bolt in an intermediate position due to an actuation of a door handle.

Slider cam 140 includes first, second, and third stepped portions 144*a*, 144*b*, and 144*c* (FIGS. 11A-B and 13A-C), which are sized and shaped differently for purposes that will become clear from the discussion below. Slider cam 140 further includes a first contact portion 146 and a second contact portion 148 (FIGS. 8A-C). The first and second contact portions 146, 148 are each coincident with both the first and second stepped portions 144*a-b*. As best seen in FIGS. 8A-C, 10A and 11A, the lock bolt 150 is in a locked, extended position and slider cam 140 is in the first position. As shown, full retraction of draw bar 120 is not possible because slider cam 140 resides in a first position in the path of travel of the draw bar 120 and is unable to move out of the path due to the presence of lock bolt 150 in the extended position, as well as a second movable member 142, as will be discussed below. For sake of discussion, assuming that second movable member 142 is not in the path of movement or is easily movable from the path of movement of the slider cam 140, if the draw bar 120 were moved to the right as viewed in FIGS. 8A-C and 10A, a leading edge 152 of the draw bar 120 would contact first contact portion 146 of slider cam 140 to begin rotation of slider cam 140. However, due to contact between second contact portion 148 and lock bolt 150, further rotation of slider cam 140 is impeded. However, as best seen in FIGS. 9, 10B, and 11B, when the lock bolt 150 is retracted, the slider cam 140 may continue to rotate to the second position as draw bar 120 advances, as leading edge 152 bears against and cams along first contact portion 146 of slider cam 140.

Retraction of the draw bar 120 is further impeded by another structure preventing the slider cam 140 from moving a sufficient amount out of the path of movement of the draw bar 120, to the second position of the slider cam 140. Specifically, referring to FIGS. 10A-12B, slider cam 140 is further prevented from moving the sufficient amount due to the presence of second movable member, herein also referred to as a lever 142. Lever 142 is mounted about a pivot 154 for rotation along the same plane of movement of draw bar 120 or, alternatively, a plane parallel to the plane of movement of the draw bar 120. Lever 142 is normally biased towards the slider cam 140 by spring 156 (FIGS. 6A-B, 10A-B). Lever 142 includes an elongate first arm 158 configured to interact in a cammed relationship with second stepped portion 144*b* of slider cam 140. First arm 158 includes a second arm 160 extending transversely and, as shown specifically in this embodiment, perpendicularly therefrom. The second arm 160 is selectively blocked by blocker member 27 of access control 16. The blocking of second arm 160 prevents the rotation of lever 142 about pivot 154 due to camming action between the first arm 158 and second stepped portion 144*b*.

Figure 12B:
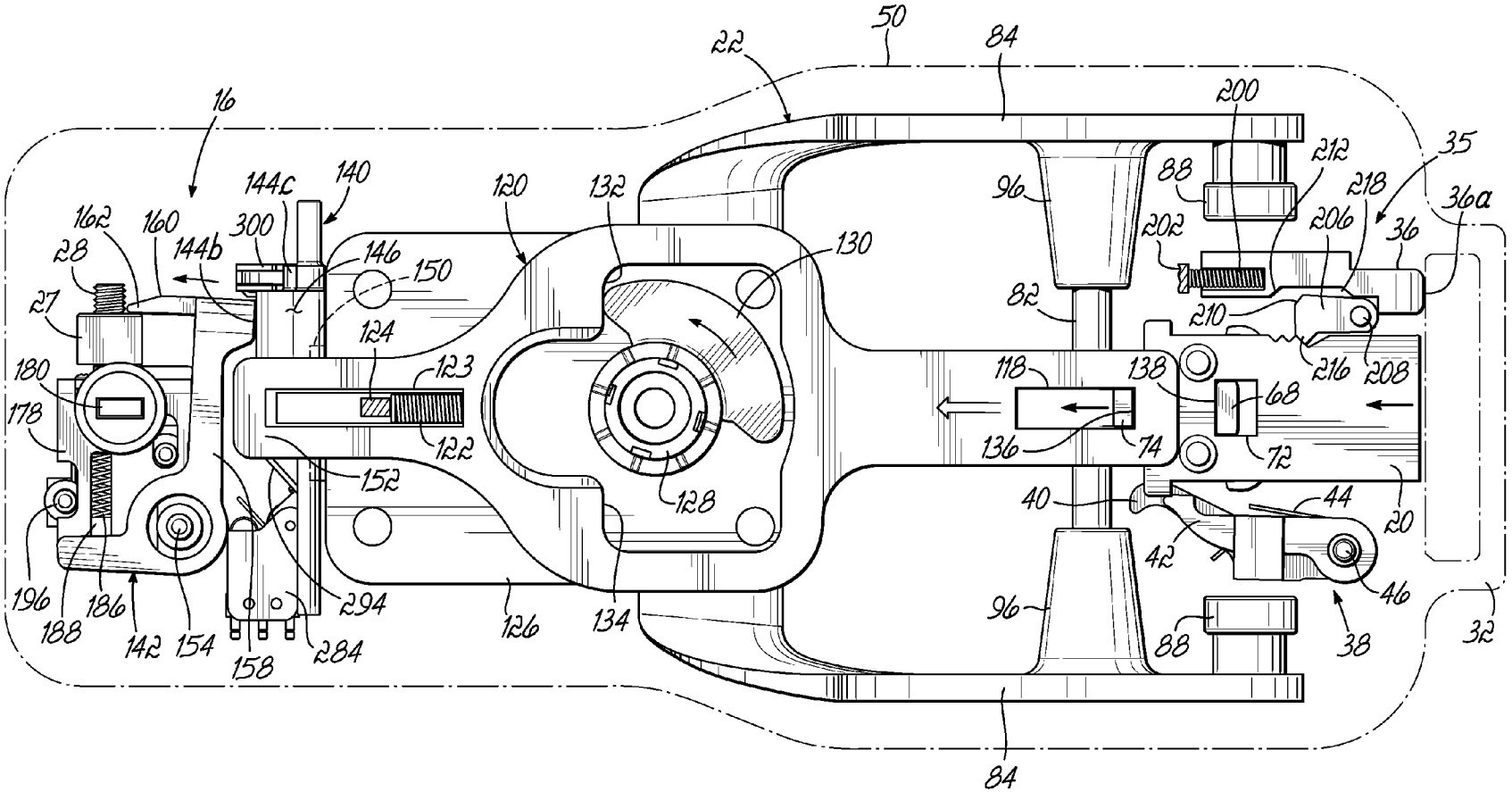
FIG. 12B shows a detailed front view of certain components of the system of FIG. 1, associated with retracting and extending the dead bolt, with the dead bolt in a retracted position.
Figure 12C:
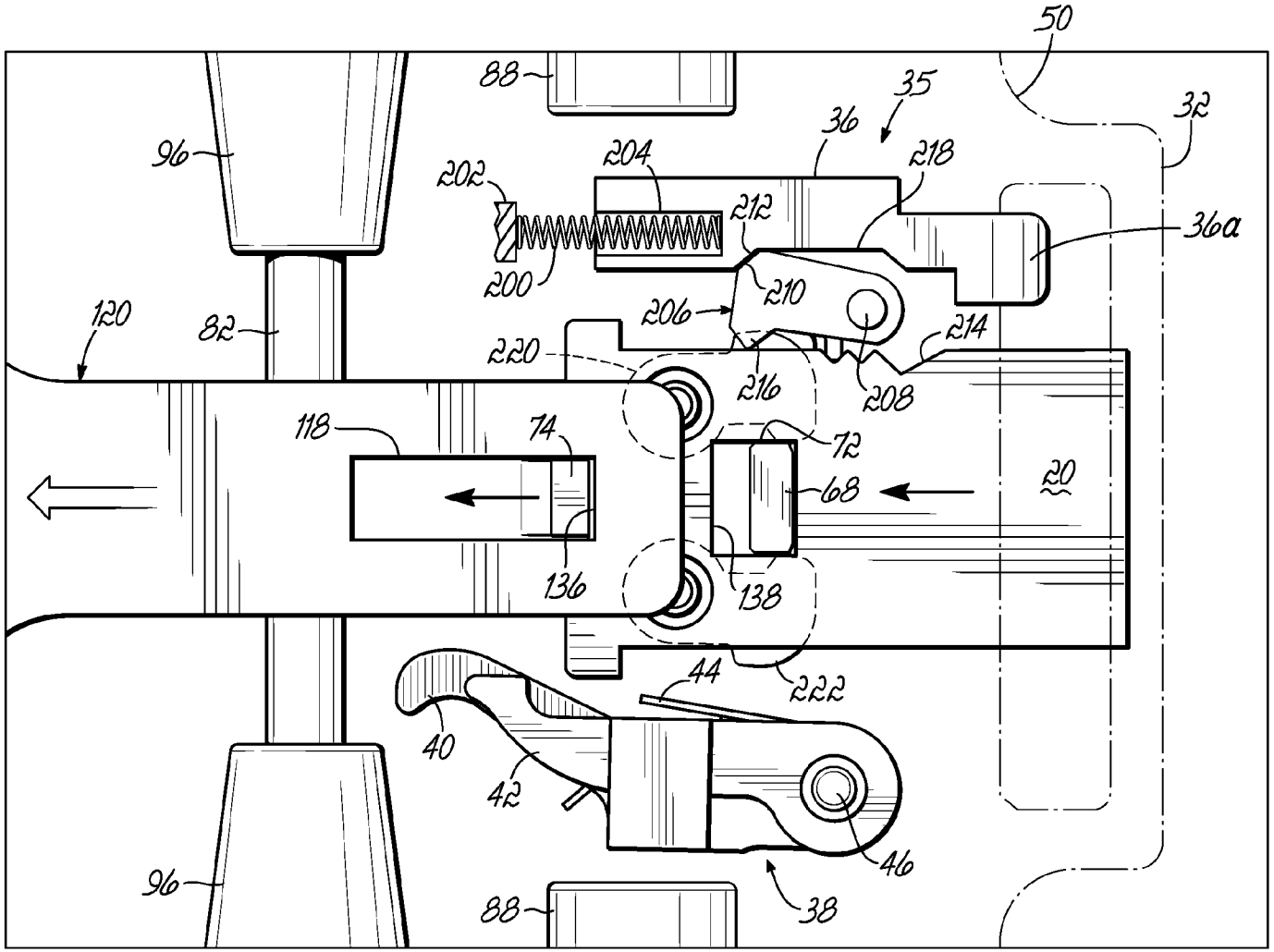
FIG. 12C shows a detailed front view of certain components of the system of FIG. 1, associated with retracting and extending the dead bolt due to actuation of a door handle, with the dead bolt in an extended position.

During rotation of slider cam 140, arm 158 essentially acts as a cam follower and follows along the slider cam 140. More specifically, arm 158 follows along second stepped portion 144*b*. As slider cam 140 rotates, lever 142 is able to move outwardly as elongate arm 158 cams along the smaller cross-sectional dimension (i.e., diameter) portion (FIG. 12A) to the larger cross-sectional dimension (i.e., diameter) portion (FIG. 12B) of the second stepped portion 144*b*, provided that access control 16 is in the unlocked position (FIG. 12B). When access control 16 is in the locked position (FIG. 12A), an access control blocker member 27 substantially abuts an end 162 of the second arm 160 and thereby prevents the movement of the lever 142 just described. However, when access control 16 is in the unlocked position (FIG. 12B) such that the blocker member 27 is displaced from its normal position, lever 142 may move outwardly as it follows the second stepped portion 144*b* during rotation of slider cam 140. Moreover, because the slider cam 140 is permitted to rotate into its second position such that it has moved a sufficient amount out of the path of the draw bar 120, the draw bar 120 may fully retract such that the dead bolt 20 is also retracted. As best seen in FIG. 10, as draw bar 120 further retracts, face 164 of draw bar 120 slides against at least first contact portion 146. Notably, certain portions of access control 16, and its associated motor 26, are associated with or mounted on mounting block 166 (FIG. 4) and controlled by circuit board assembly 25 (FIG. 4 through 5B).

Essentially, upon lock 14 and access control 16 being in the unlocked positions, simple movement of the draw bar 120 causes the displacement of the slider cam 140 out of the plane, axis, or path of movement of the draw bar 120 such that when in the second position, the slider cam 140 does not intersect the plane, axis, or path of movement of the draw bar 120. It will be understood that the first and second positions of the slider cam 140 may not be exactly as those shown and the first and second positions are meant to refer to one or more positions where the slider cam 140 prevents (first position) or allows (second position) the further axial movement of draw bar 120. The lock bolt 150 and slider cam 140 are configured and/or positioned relative to one another such that when the lock bolt 150 is in the extended position, the slider cam 140 may not move, or rotate, to the second position regardless of the condition of the access control 16. Similarly, the slider cam 140 and lever 142 are configured and/or positioned such that when access control 16 is in the locked condition, the slider cam 140 may not move, or rotate, to the second position regardless of the condition of the lock bolt 150. In a preferred embodiment, the slider cam 140 is mounted for rotational movement about a first axis 168 (FIG. 10A) that is essentially transverse to an axis of movement of the draw bar 120. As shown, the axis 168 of rotation of the slider cam 140 is perpendicular to the axis 170 (FIG. 10A) of movement of the draw bar 120. Also as shown, lock housing 126 and lock bolt 150 are positioned such that the lock bolt 150, as it moves between the extended and retracted positions, moves along a plane (not shown) parallel to a plane of movement of the draw bar 120. However, the lock housing 126 and lock bolt 150 may be situated or positioned in a different manner such that the lock bolt 150 moves in a direction transverse to the plane of movement of the draw bar 120. Furthermore, as best viewed in FIGS. 8A-C and 9, when the dead bolt 20 moves from the extended position (FIG. 8A) to the retracted position (FIGS. 8B-C and 9), it moves in a first direction as indicated by arrow 171*a* (FIG. 8A). On the other hand, as the lock bolt 150 moves from the locked position (FIG. 8A) to the unlocked position (FIG. 9), lock bolt 150 moves in a second direction as indicated by arrow 171*b*. Thus, the first and second directions are opposite to one another in the embodiment shown. However, in other embodiments, the first and second directions may be different than one another, such that the first and second directions are transverse or perpendicular to one another.

Override Mechanism

Referring to FIGS. 1-2 and 13A-C, the system 10 includes an override 30 configured to displace the access control 16 assembly such that the blocker member 27 is positioned out of the path of movement of second arm 160 of lever 142 even when access control 16 is in the locked position. The override 30 is operable by turning a key 172 in override key assembly 174, which is connected to front cover 246 by support plate 176. Turning the key 172 essentially displaces certain components of access control 16, making it unnecessary to actuate access control 16 in order to retract dead bolt 20 (provided that other conditions are met). In that regard, blocker member 27 is connected via threaded rod 28 to slide 178 which is movable from a first position (FIG. 13B) to a second position (FIG. 13C) upon rotation of shaft 180 by key 172, to thereby move the blocker member 27 from a first position where it can block second arm 160 of lever 142, to a second position where it does not block second arm 160 of lever 142. Slide 178 includes a substantially horizontal aperture 182 that receives pin member 184. Pin member 184 is operatively connected to shaft 180 and positioned non-concentrically relative to an axis of rotation of the shaft 180 such that the camming interaction of the pin member 184 with the horizontal aperture 182 may provide for linear movement. Therefore, as shaft 180 rotates due to rotation of key 172, pin member 184 cams along horizontal aperture 182 and draws the slide 178 downward in a substantially vertical direction, thereby compressing spring 186 which bears against stop 188. Spring 186 normally biases slide 178 into the first position. Further contributing to the substantially vertical movement of slide 178, slide 178 includes a vertically oriented aperture 190 which accepts a pin 192 such that in the first position, pin 192 is at one end of aperture 190, and in the second position, pin 192 is at the other end of aperture 190. Similarly, slide 178 includes a channel 194 interacting with another pin 196 which, when slide 178 is in the first position, pin 196 is at one end of channel 194, and in the second position, pin 196 is at the other end of channel 194. The configuration of pin 192 and aperture 190, as well as the configuration of pin 196 and channel 194, essentially advantageously allows a certain distance D of vertical movement (in the direction of arrow 198 (FIG. 13B)). Thus, as the slide 178 is moved to the second position and moves the blocker member 27, movement of the lever 142 in the same manner as described above, is permitted and, therefore, the draw bar 120 may be displaced to allow retraction of the retracting structure 62 and thus the dead bolt 20. It should be appreciated that the override 30 only acts to prevent access control 16 and thus lever 142 from obstructing retraction of the draw bar 120, and that lock 14 will have to be unlocked in order to allow full retraction of draw bar 120 and thus retraction of dead bolt 20 as described herein. Thus, system 10 provides at least two levels of security that must be overcome in order to retract dead bolt 20. It will be appreciated that override 30 is not limited to the configuration disclosed herein. For example, other configurations are possible such that the certain portions of access control 16 (such as blocker member) may be displaced in a different manner, such as angularly or horizontally.

Dead Bolt Hold Back Mechanism

Figure 13A:
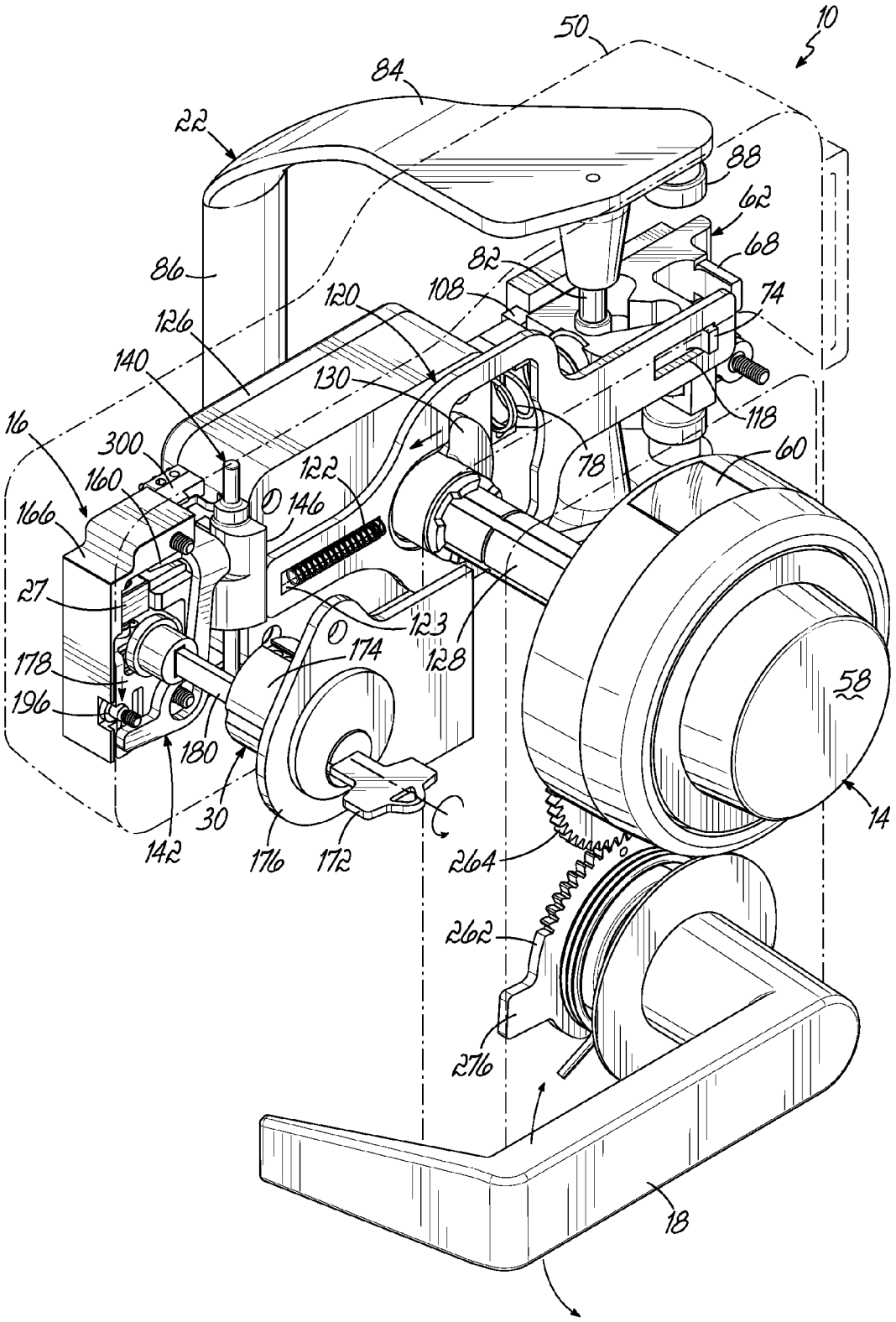
FIG. 13A is an alternative perspective view of the system of FIG. 1, showing internal components.
Figure 13B:
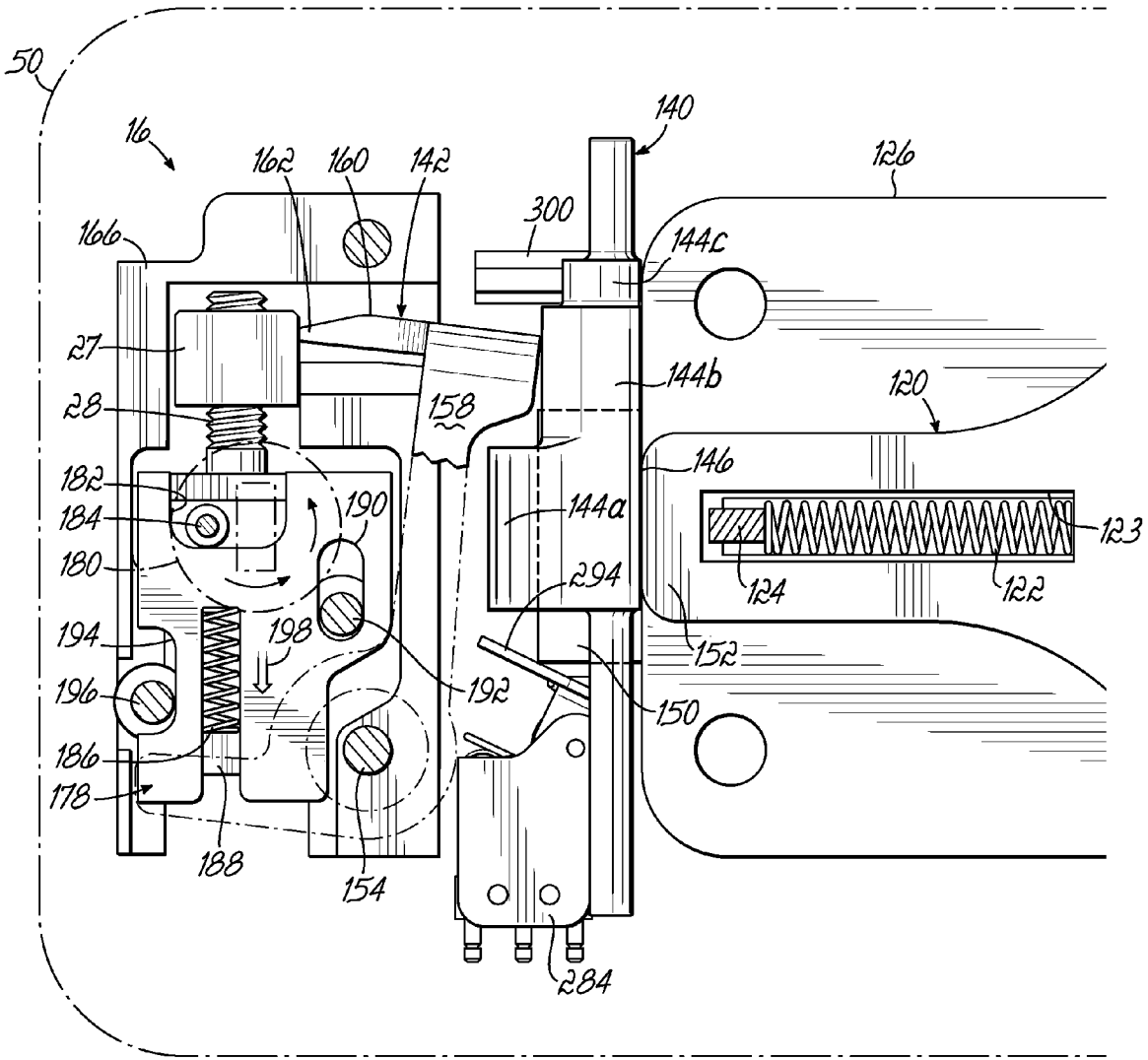
FIG. 13B is a detailed front view of the system of FIG. 1 showing certain internal components.
Figure 13C:
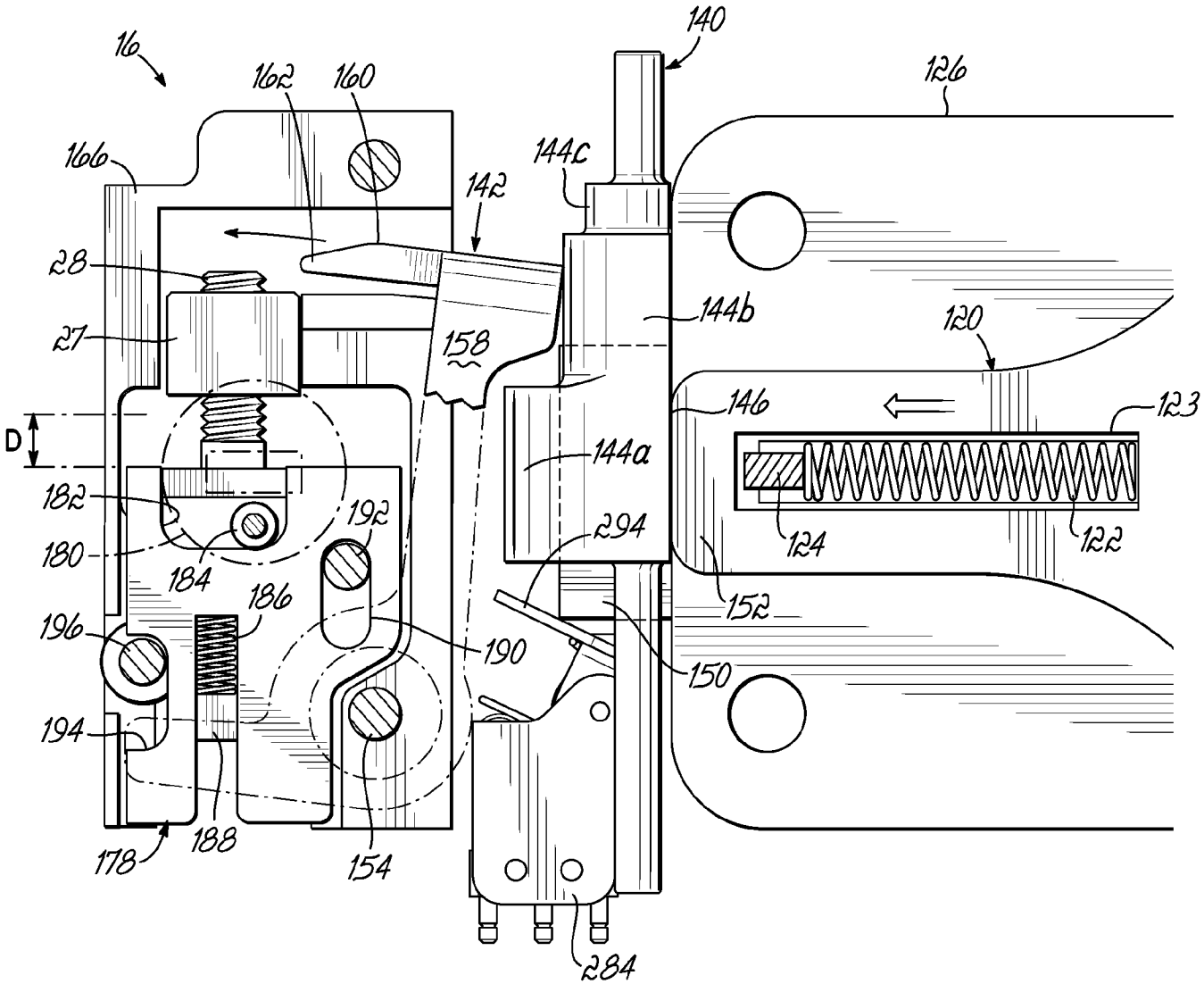
FIG. 13C is another detailed front view of the system of FIG. 1 showing certain internal components.

Lock system 10 further includes a dead bolt hold back mechanism 35 as best shown in FIGS. 6A-B and 12A-C. This feature is designed to hold dead bolt 20 in a retracted position while door 12 is opened and operated by trigger as generally mentioned above. More specifically, trigger member 36 is an elongate member which extends from housing 50 into bail 32 at one end and is biased by a compression spring 200 at the opposite end. Spring 200 is restrained by a stationary stop 202 associated with housing 50 and within a blind hole 204 contained in trigger member 36. A pivoting hold back element 206 is connected to a pivot 208 to a suitable portion of housing 50, for example, and includes a cam surface 210 which engages a cam surface 212 on trigger member 36. This holds trigger member 36 in an inward position against the bias of spring 200, as shown in FIGS. 7A and 13A, with dead bolt 20 extended. However, when dead bolt 20 is retracted, as described above and shown in FIGS. 6B and 12B, hold back element 206 will be forced to pivot inwardly through the interaction of cam surfaces 210, 212 and the force of spring 200 as another cam surface 214 contained on the side surface of dead bolt 20 reaches an upper cam surface 216 of pivoting hold back element 206.

As further shown in FIG. 6B, hold back element will be held firmly between dead bolt 20 and an upper surface of trigger member 36 with cam surfaces 214, 216 interacting to retain dead bolt 20 in the retracted position against the bias of spring 200. In this position, trigger element partially extends into bail 32. When door 12 is closed and a strike plate (not shown) enters bail 32, an exposed cam surface of 36*a* of trigger member 36 will be engaged by strike plate. This will push trigger member 36 back to the left, as shown in FIG. 6A, and cause hold back element to drop into recess 218. At the same time, dead bolt 20 will extend through strike plate. Trigger member 36 will again be held in its retracted position until dead bolt 20 is retracted again. Dead bolt hold back mechanism 35, including trigger member 36 and other associated structures are substantially similar to that described in U.S. Pat. No. 7,007,524 at column 10, lines 14 to 50, which is incorporated herein by reference.

Referring to FIGS. 7A-B,14, and 15, a force blocking structure defined by a pair of pawls 220, 222 is connected to dead bolt 20 by pivots 224, 226. First arm 68 of retracting structure 62 engages these pawls 220, 222 to facilitate a force blocking feature. Specifically, first arm 68 includes cam surfaces or beveled edge 228, 230 in engagement with respective edges or cam surfaces 232, 234 on pawls 220, 222. Pawls 220, 222 have a generally hammer-like shape with hook-like retaining surfaces 236, 238. Surfaces 236, 238 also act as cam surfaces and engage stationary posts 240, 242 connected with housing 50 when dead bolt 20 is in the extended position. In this manner, any end pressure applied to dead bolt 20, as in an attempted forced entry, is received by stationary posts 240, 242 as opposed to the other inner working components of lock system 10. As first arm 68 moves in the rearward direction as retracting structure 62 is retracted by either actuation of escape lever 22 or door handle 18, as described herein, pawls 220, 222 rotate inwardly (FIG. 7B) about respective pivots 224, 226. Once the dead bolt 20 is re-extended as described herein, edges 228, 230 cam against cam surfaces 232, 234 of pawls 220, 222 to move pawls 220, 222 back to the position shown in FIG. 7A. In summary, the pawls 220, 222 are connected to the housing structure when the dead bolt 20 is in the extended position and disconnected from the housing structure when the dead bolt 20 is in the retracted position, such that force applied to an outer end of the dead bolt 20 is transmitted to the housing structure by the pawls 220, 222 when the dead bolt 20 is in the extended position.

Torque Override Clutch Mechanism and Handle Actuating Assembly

Figure 3:
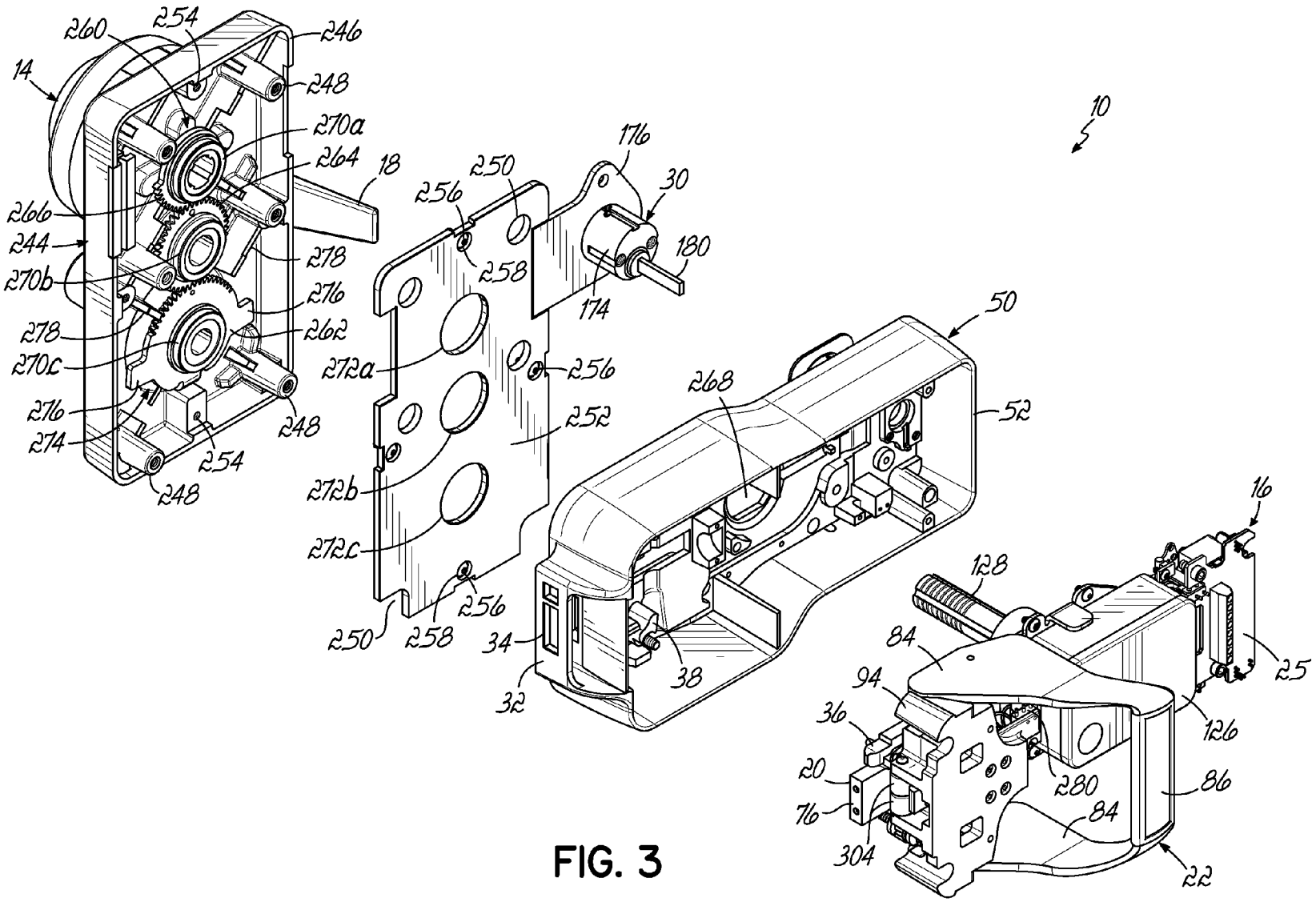
FIG. 3 is a rear perspective exploded view of the system of FIG. 1.

Turning now to FIG. 3, a handle actuating assembly 244 is provided for allowing a user to open door 12 by rotating handle 18 in either a clockwise or counterclockwise direction to retract dead bolt 20 when all other lock conditions have been met. Essentially, rotation of handle 18 is transferred to cam 130 (FIG. 5A) to operate draw bar 120 as previously described. Handle actuating assembly 244 includes a front cover 246 having fastening posts 248 that may receive fasteners (not shown) extending through back plate apertures 250 of back plate 252 and into door 12 (FIG. 1). Front cover 246 includes additional fastening points 254 that receive fasteners 256 extending through additional apertures 258 in the back plate 252. Back plate 252 is preferably used to retain the various components of actuating assembly 244 within front cover 246. These components mainly include a gear train 260 including an input gear 262 operatively connected to door handle 18 and engaging an idler gear 264 which, in turn, engages an output gear 266 engaging output shaft 128 extending through output shaft aperture 268 in housing 50. Each of the respective gears includes a mounting portion 270*a-c*, which is received by support apertures 272*a-c*. These and further features of the handle actuating assembly 244, as well as the torque override clutch mechanism, at least a portion of which is shown at reference numeral 274, are substantially similar to those disclosed in U.S. Pat. No. 7,007,524, specifically column 11, line 43 to column 12, line 59, which disclosure is incorporated herein by reference. Also included in the handle actuating assembly and/or the torque override clutch mechanism are wings 276 provided on input gear 262, which act as a secondary mechanism for preventing damage to components due to excessive torque applied to door handle 18. To that end, one of the wings 276, depending on which direction the door handle 18 is rotated, bears against one of the support flanges 278 extending outwardly from front cover, which act as stops to prevent further rotation of the input gear 262.

Lock Monitoring Switches

Figure 10A:
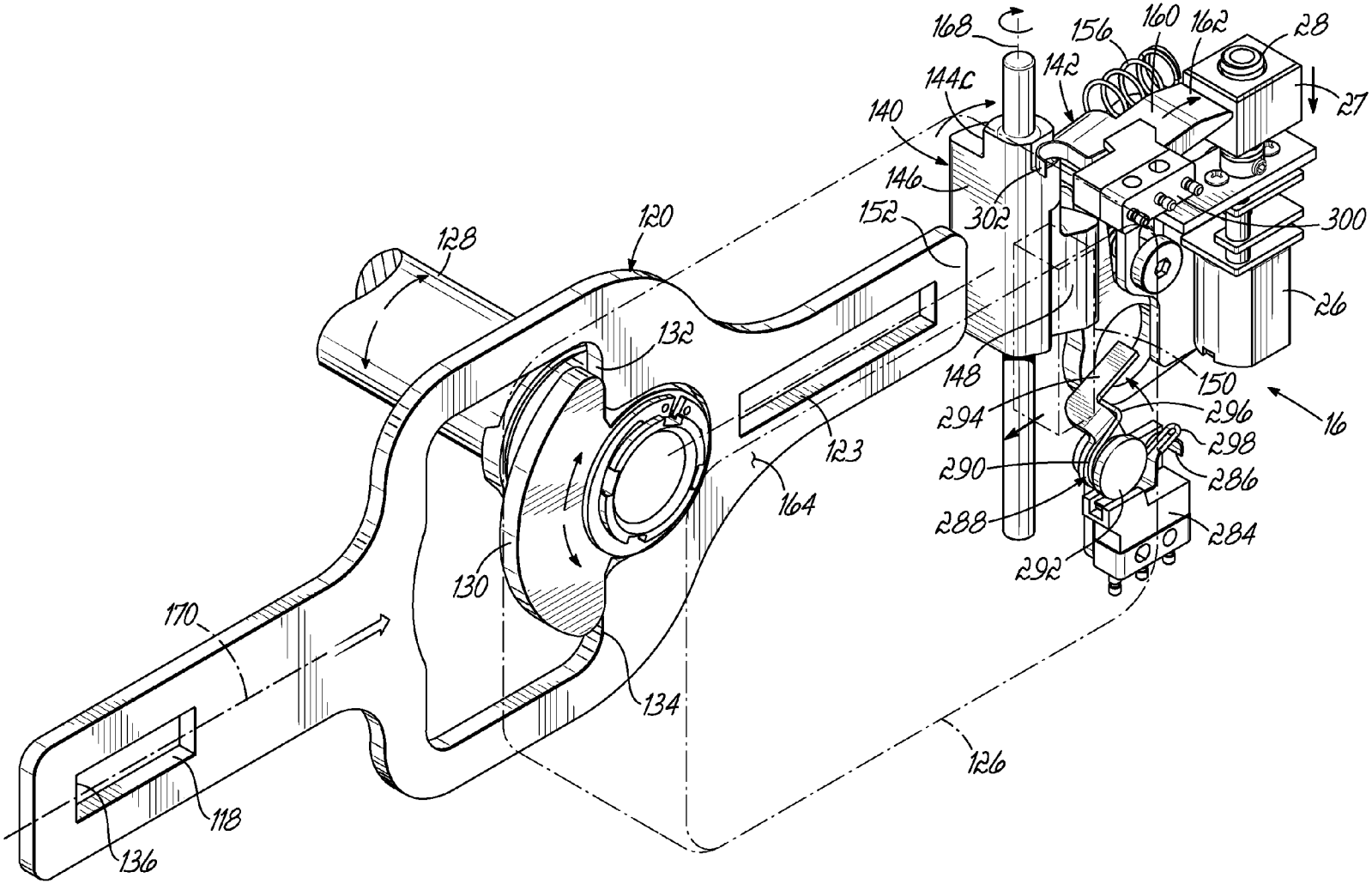
FIG. 10A shows a rear perspective view of certain components of the system of FIG. 1, associated with retracting and extending the dead bolt.
Figure 10B:
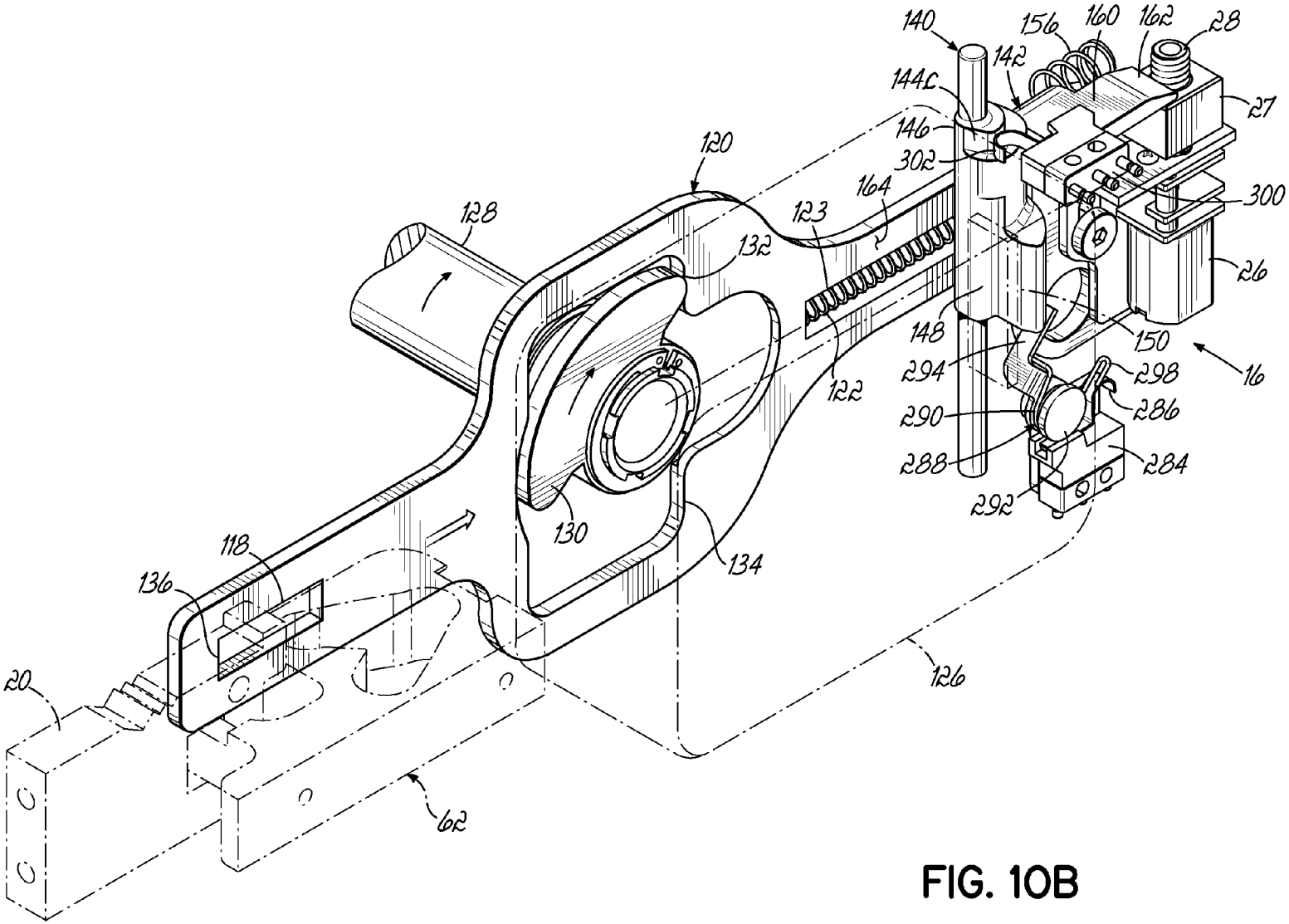
FIG. 10B shows a rear perspective view of certain components of the system of FIG. 1, associated with retracting and extending the dead bolt.
Figure 11A:
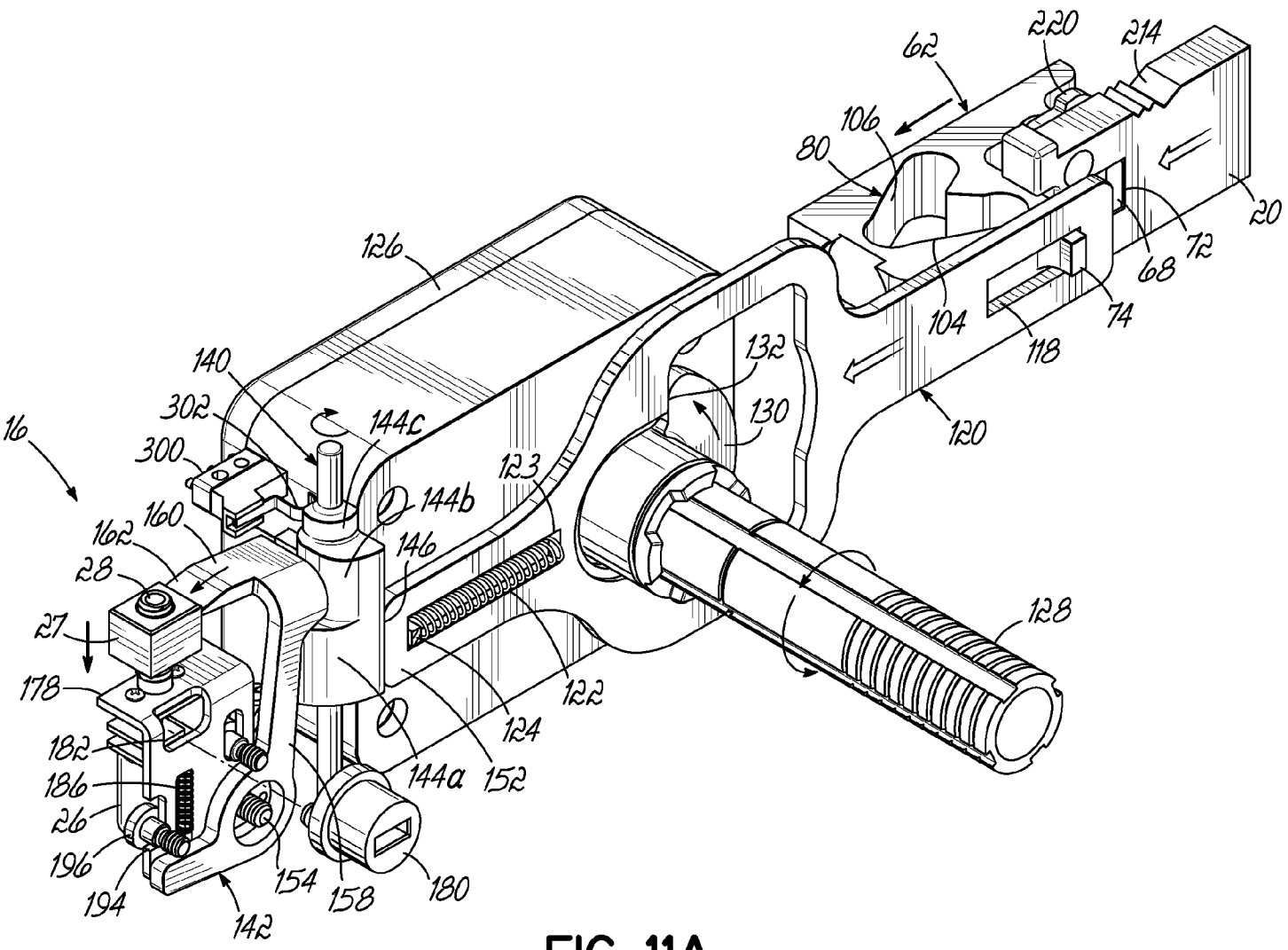
FIG. 11A shows a front perspective view of certain components of the system of FIG. 1, associated with retracting and extending the dead bolt, with the dead bolt in the extended position.
Figure 11B:
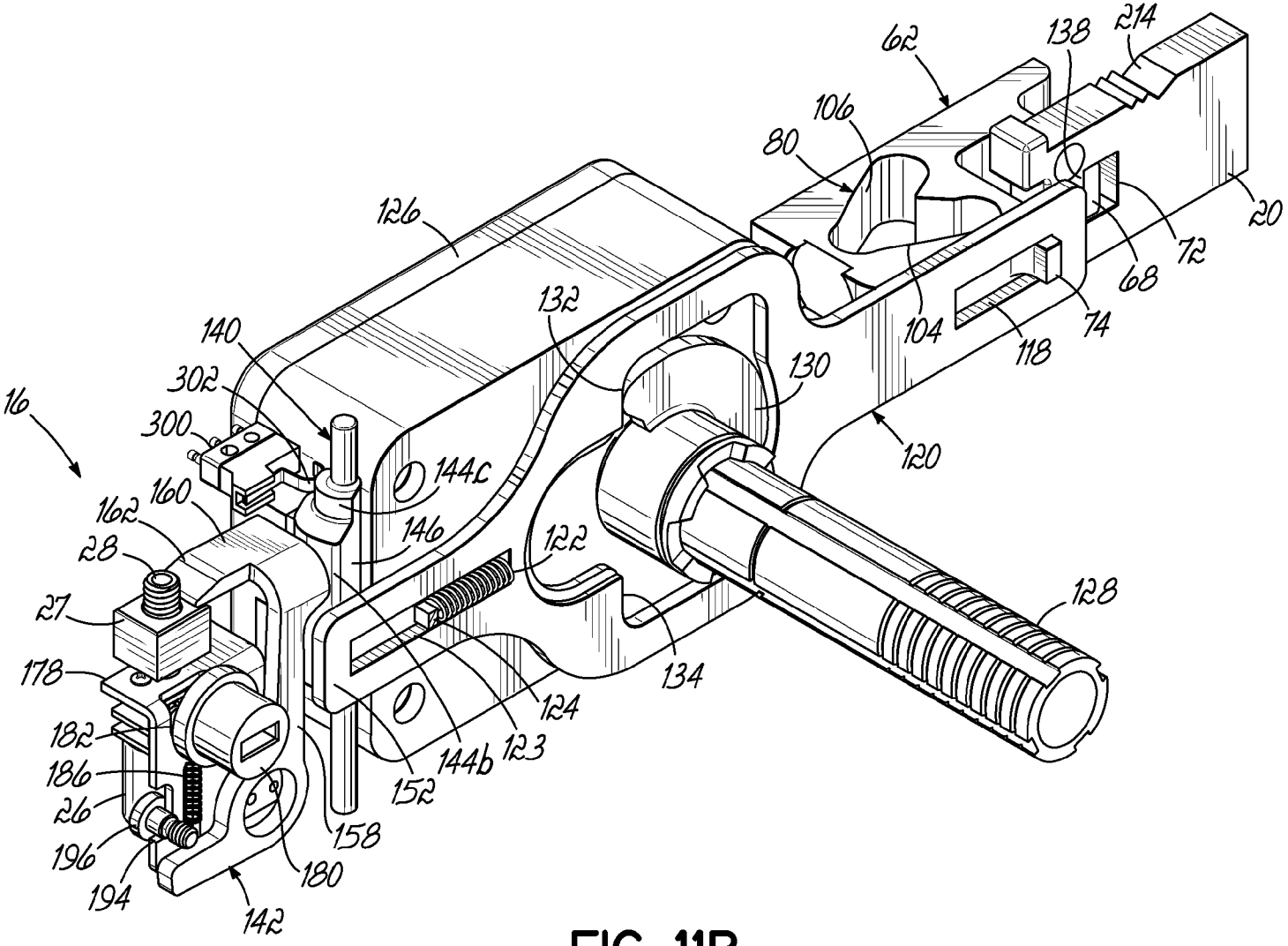
FIG. 11B shows a front perspective view of certain components of the system of FIG. 1, associated with retracting and extending the dead bolt, with the dead bolt in the retracted position.
Figure 12D:
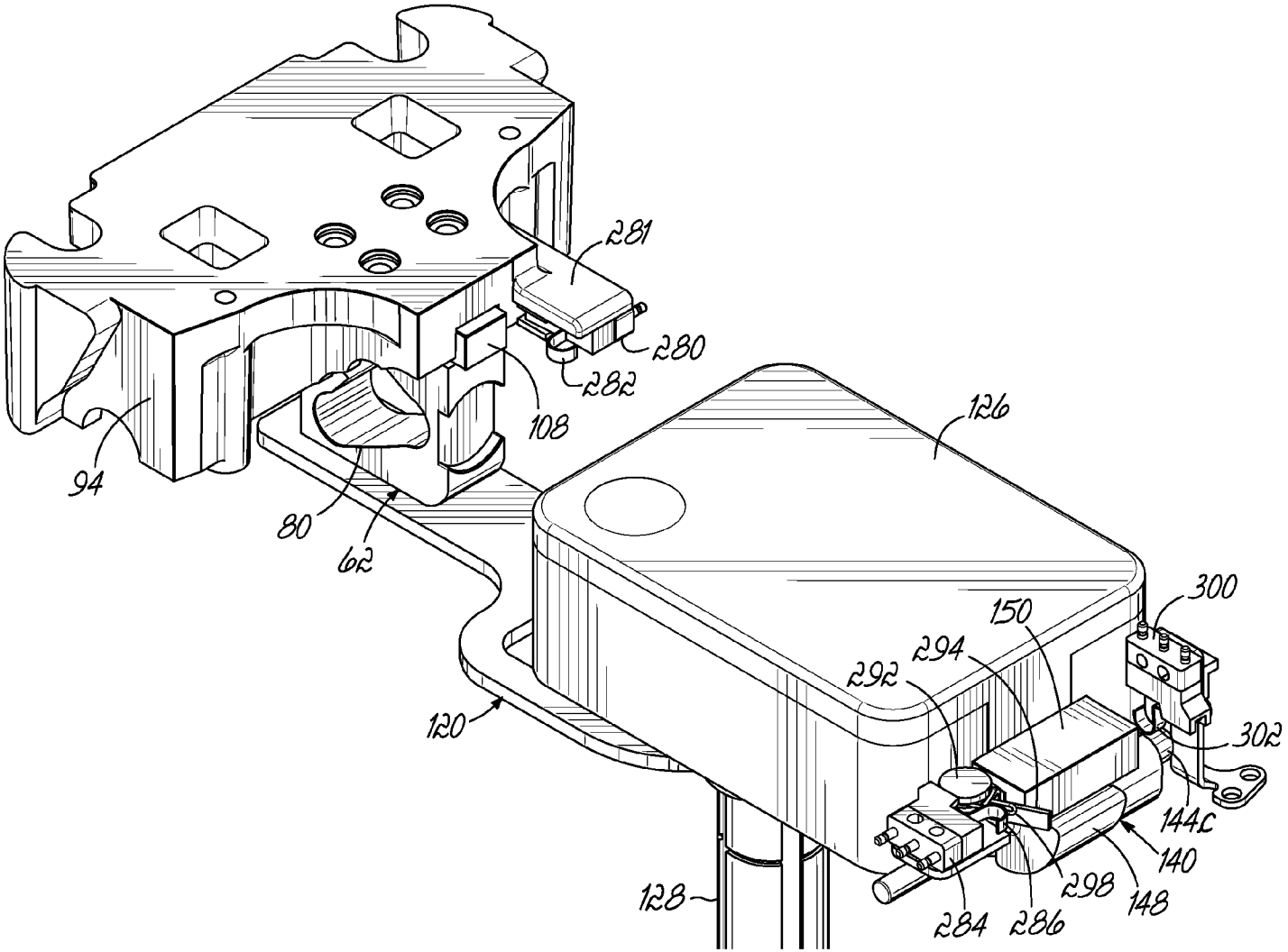
FIG. 12D shows a perspective view of certain internal components of the system of FIG. 1.

As best seen in FIGS. 6A-B, 10A-B, 11A-B, 12A-B, and 12D, various electrical sensing devices may be used in carrying out the concepts of the present invention. Referring specifically to FIGS. 6A-B and 12D, microswitch 280, which is held in place by rear wing 281, is provided to indicate the position of dead bolt 20, particularly whether dead bolt 20 is in the extended position or the retracted position. Microswitch 280 includes a hook-shaped finger 282 that is contacted by the retracting structure 62, or the slider bearing 108 coupled with the retracting structure 62, as the retracting structure 62 (and thus dead bolt 20) retracts. Similarly, as the retracting structure 62 moves in the opposite direction so as to extend the dead bolt 20, the finger 282 may no longer be contacted by the retracting structure 62 or slider bearing 108. However, it is possible that the switch 280 is configured such that the retracting structure 62 or other associated structure remains in contact with the finger 282 when the dead bolt 20 is in the retracted and extended positions.

Referring to FIGS. 10A-B and 12D, another microswitch 284 is provided to indicate whether the lock bolt 150 is in the extended (locked) position or the retracted (unlocked) position. Microswitch 284 includes a finger 286 which is positioned to be born against by a torsion spring 288. More specifically, torsion spring 288 includes a coiled portion 290 coiled around circular member 292. An appendage 294 extends from the circular member 292 towards lock. The torsion spring 288 is positioned such that a first arm 296 thereof biases the appendage 294 towards the lock in its normal position. A second arm 298 of the torsion spring 288 bears against finger 286 of the microswitch 284. When lock bolt 150 is in the extended position, lock bolt 150 contacts appendage 294 and appendage 294 thereby bears against first arm 296 of torsion spring 288, which transfers some of the force to the second arm 298 of the torsion spring 288, part of which is transferred to the finger 286 of microswitch 284. This transferred force sensed by the microswitch 284 indicates that the lock bolt 150 is in the extended position. However, when lock bolt 150 is in the retracted position, lock bolt 150 may not contact, or may contact to a lesser extent, the appendage 294. Thus, the microswitch 284 may sense that lock bolt 150 is in the retracted position.

Still referring to FIGS. 10A-B, 11A-B, 12A-B, and 12D, microswitch 300 detects the position of slider cam 140. Microswitch 300 includes a movable arm 302 and is positioned such that the movable arm 302 interacts with the third stepped portion 144*c* of the slider cam 140 as it rotates. As best viewed in FIG. 11A, when slider cam 140 is in the first position, movable arm 302 bears against a flat portion of third stepped portion 144*c*. As slider cam 140 rotates to the second position, as best viewed in FIG. 11B, movable arm 302 cams with the curved portion of third stepped portion 144*c*. By detecting the position of the slider cam 140, microswitch 300 may be used to monitor or detect the actuation of the handle 18 (via interaction between the handle 18, cam 130, draw bar 120 and slider cam 140 described herein), and thus entrance from the outside into a room or facility that the system 10 is used to secure.

Microswitches 280, 284, and 300, as well as additional switches or sensing devices, may be used to indicate the respective system conditions, such as the conditions of dead bolt 20, lock bolt 150, and slider cam 140, or potentially other members of the system 10, on a suitable control panel. Switches 280, 284, and 300 may be wired in series to indicate an overall locked or unlocked condition of system 10. Instead, they may be wired to separate indicators, such as lights, to indicate the separate conditions of at least lock 14, access control 16, and dead bolt 20.

Electrical sensing devices, such as switches 280, 284, and 300, or other devices, may also be used for audit or tracking purposes. For example, data associated with the switches 280, 284, and 300, and thus the system 10, may be saved on a memory device on or associated with the system 10. Finally, as mentioned above, electrical sensing devices, such as switches 280, 284, and 300, may be situated as exemplified by switch 284 such that the actuating arm thereof acts as a test member to test the condition of a security lock associated with lock system 10. For example, switch 284 may be used to determine whether lock is operable such that lock bolt 150 retracts and/or extends upon the input of correct unlocking or locking information. Such a switch or sensing device could then potentially activate access control 16 or other electromagnetic lock, if so equipped, to render the dead bolt retracting structure 62 associated with the system 10 operable or inoperable by door handle 18 as generally described in accordance with the invention.

At a Glance Lock Status

In many situations it is advantageous to know whether, upon closing the door, the dead bolt 20 has moved to the extended position, through the bail 32, and into the doorjamb, wall, or other structure. It is possible that an authorized person trying to gain access to a secure area may arrange to have the deadbolt blocked from re-extending upon closing of the door. Such blocking may be completed in many ways, such as by inserting an object into or disabling a certain structure in the system 10 to prevent the passage, extension, or movement of the dead bolt 20 once the door closes. In an ordinary door, a person may be able to view whether the dead bolt 20 is extended by viewing the space between an edge of the door and the door jamb. However, in high security environments, a space between the door jamb and door may not be visible due to sound sealing insulation or other materials or structure, making it impossible to see whether the dead bolt 20 is in the extended position or the retracted position. Because high security doors may include trigger mechanisms like those described above that prevent the dead bolt 20 from extending when the door is open, and because the escape lever 22 is meant to retract the dead bolt 20 upon actuation of the escape lever 22, opening the door from the inside with the escape lever 22 or from the outside with handle to check the status of the dead bolt 20 may not tell the user if the dead bolt 20 or an associated structure has been tampered with. This is especially true when interior components have been tampered with and an external view of the dead bolt 20 and associated structures will not indicate the tampering.

In this regard, the escape lever 22 occupies a first, neutral position (FIG. 8A) when the dead bolt 20 is extended, and a second, inward position or a third, outward position when the dead bolt 20 is retracted. Due to the interaction between the dead bolt retracting structure 62 and the movable arm 82 of the escape lever 22 as the handle 86 is pushed, the movable arm 82 cams against the first cam portion 104 of the retracting structure 62. Escape lever 22 moves to an inward position (FIG. 8B) as the movable arm 82 reaches the first position relative to the retracting structure 62. Similarly, if the handle 86 is pulled, the movable arm 82 cams against the second cam portion 106 and the escape lever 22 moves to an outward position (FIG. 8C) as the movable arm 82 reaches the second position relative to the retracting structure 62. Once the handle 86 is released, there are still several structures impeding the dead bolt retracting structure 62 from moving towards the bail 32 to extend the dead bolt 20, and thus impeding the movable arm 82 from camming back to the neutral position and therefore impeding the escape lever 22 from moving back to the neutral position. For example, referring to FIG. 7B, after the escape lever 22 is actuated (whether pushed or pulled), the pawls 220, 222 engage a front of the first arm 68 of the retracting structure 62. Even without the presence of pawls 220, 222, trigger member 36 prevents dead bolt 20 from extending before the trigger member 36 contacts the strike plate. Therefore, even without the pawls 220, 222, retracting structure 62 would still only be able to advance through slot 72 of dead bolt 20 a small amount. The second cam notch 102*b* in cam aperture 80 also provides some of the force that maintains movable arm 82 in the position shown in FIG. 7B when the escape lever 22 is pushed. Therefore, until the door is closed and the trigger member 36 contacts the strike plate to thereby allow the dead bolt 20 to extend, movable arm 82 is either in the first position, whereby handle 86 is in the inward position, or the second position, whereby handle 86 is in the outward position. Thus, if the door is closed but the dead bolt 20 is somehow impeded from extending, it will be apparent from the inside of the door, based on the position of the escape lever 22.

Deadbolt Bearings

For safety reasons, it is advantageous to provide a door that is openable by persons of all sizes and strengths. Furthermore, it is advantageous to maintain the ease of opening a door even when a force transverse to the dead bolt 20 is being applied to the door. Moreover, in high security doors that are sound sealed, the pressure on the lock system 10 and thus the dead bolt 20 varies. To that end, referring to FIGS. 8A-C and 9, the system 10 includes bearings 304, in one embodiment specifically needle bearings, rotatably mounted on mounting structures or pins 306 in the casting 94, that support the dead bolt 20 such that regardless of the pressure changes due to the sound sealing of the door, or regardless of the load on the door itself (i.e., due to a person pushing), the pressure on the dead bolt 20 remains substantially constant. For at least that reason, bearings 304 remove the additional drag from any horizontal (i.e., transverse or perpendicular to dead bolt 20) force on the door. In order to supplement the advantages as described herein, the strike plate and/or door jamb may also include bearings (not shown).

Panic Bar

Referring to FIGS. 16 through 18C, an alternative embodiment of a system 400, utilizing many features of system 10 as described above, is shown. In that regard, many of the components of this embodiment of the system 400 are identical or substantially similar to the components described with respect to system 10, and these components have been marked with the same reference numbers in this embodiment without additional explanation below.

System 400 includes a panic bar assembly 401. As described herein, and as understood in the art, the term or phrase panic bar is meant to refer to a structure or mechanism that extends along at least half of the width of a door and is provided as a life safety feature. Panic bar assembly 401 includes an elongated housing 402, a first part 404 of which (on the left side as viewed in FIG. 17) is substantially similar in shape to the housing 50 (FIG. 1) described above such that many of the system components associated with retracting and extending the dead bolt 20 (referred to hereinbelow as the lock and dead bolt assembly 405 (FIG. 17)) need not be substantially altered in order to be used with panic bar assembly 401. Second portion 406 includes a generally rectangular elongate shape such that it may cover a larger portion of the door 12 and allow a potentially more user friendly manner of retracting the dead bolt 20 and opening the door 12 in a panic situation. Housing 402 includes a front member 408 and a rear member 410. The panic bar assembly 401 further includes a push bar 412 that is operative to push the modified escape lever 22' in the same manner described herein to retract the lock bolt 150. Push bar 412 includes an outer portion 413 which is configured to be pushed or pressed by a user.

Figure 18A:
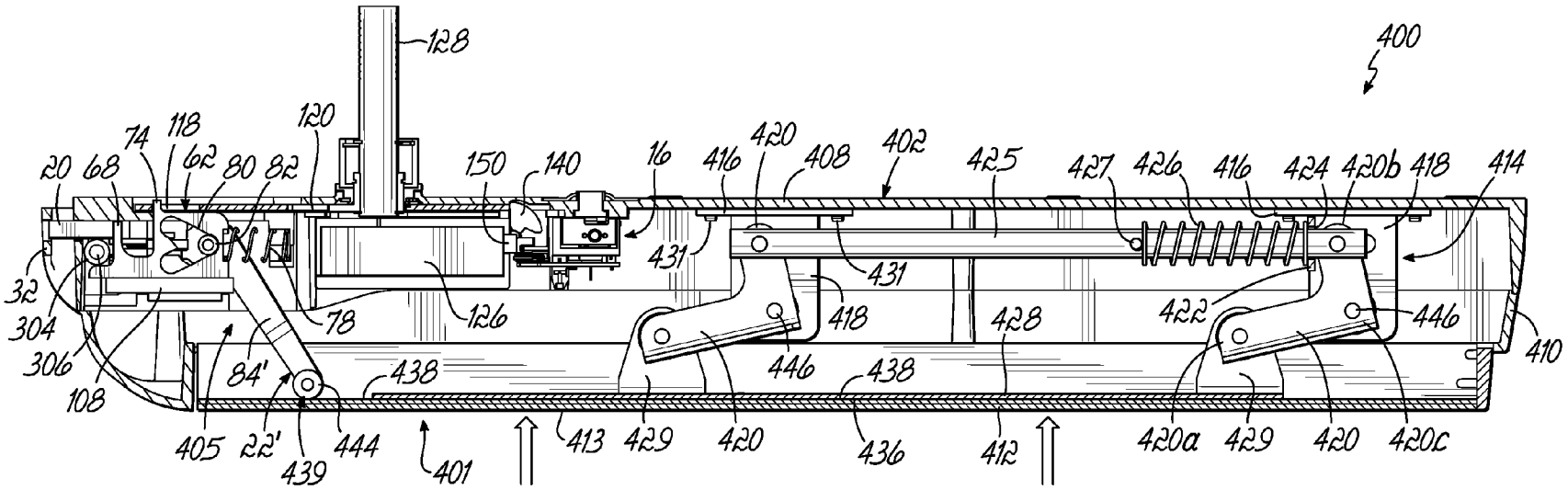
FIG. 18A shows a top view of the system of FIG. 16, with the dead bolt in an extended position.
Figure 18B:
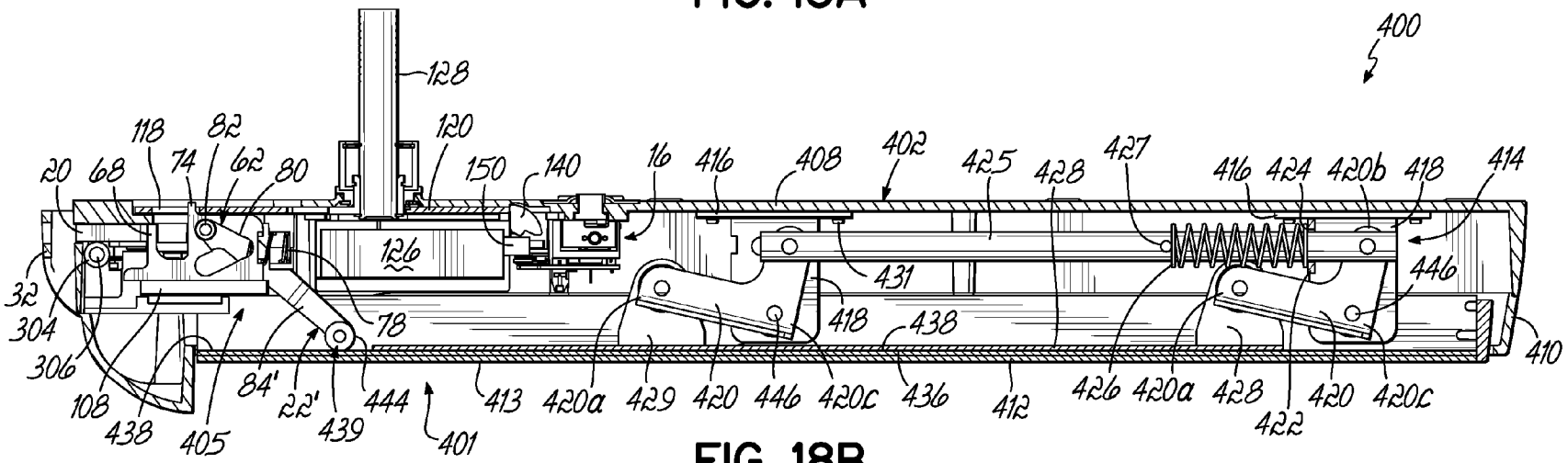
FIG. 18B shows a view similar to FIG. 18A, with the dead bolt in a retracted position due to actuation of the panic bar.

Biasing assembly 414 includes mounting plates 416 for mounting the assembly to the panic bar assembly 401, and more specifically, the second portion 406 of the housing 402. Mounting plates 416 each include other support structure that provide support for or facilitate coupling to other components of the assembly. More specifically, the mounting plates 416 each include opposing support flanges 418 extending outwardly from the mounting plates for supporting a portion of pivoting members 420. Biasing assembly 414 also includes support structure 422 having an aperture 424 for receiving rod 425. A spring 426 is mounted around a portion of rod 425 and is positioned between the support structure 422 and a pin 427 extending or protruding from rod 425. Biasing assembly 414 also includes a bar 428, which includes two inwardly extending support flanges 429. As best seen in FIGS. 18A-B, each pivoting resilient member 420 is coupled to a support flange 429 of the bar 428, a support flange 418 of the mounting plate(s) 416, and a portion of the rod 425. In that regard, a first end 420*a* of each resilient member 420 is pivotably coupled to support flange 429 of bar 428. A second end 420*b* of each resilient member 420 is pivotably coupled to the rod 425. A middle portion 420*c*, near the L-shaped joint, is pivotably coupled to the support flange 418 of the mounting plate(s) 416.

The lock and dead bolt assembly 405 includes a lever member or modified escape lever 22' having modified arms 84' with a connecting portion 85' therebetween. To assemble the system 400, lock and dead bolt assembly 405 is directed into and situated in first part 404 of housing 402. Mounting plates 416 are coupled to second portion 406 of housing 402 supporting the using fasteners 431 (FIGS. 18A-B) through apertures 432 in the mounting plates 416 and apertures 433 in the housing. Outer face 436 of biasing bar 427 is coupled with inner face 438 (FIGS. 18A-B) of push bar 412. Finally, rear member 410 of housing 402 is coupled to the rest of the assembly by situating apertures 440 of housing 402 relative to fastener members 442, and fasteners (not shown) are used to couple the rear member 410 to the front member 408.

Figure 18C:
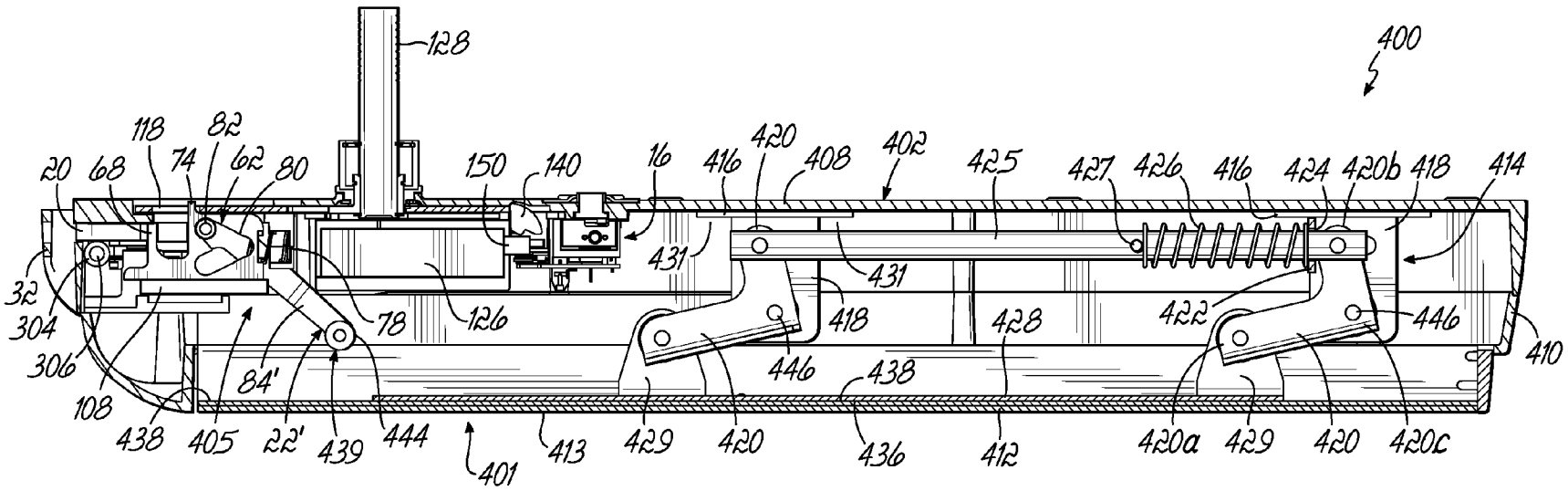
FIG. 18C shows a view similar to FIG. 18A, with the push bar spaced from the escape lever.

Push bar 412 is normally biased into a position (FIG. 18A) such that the inner portion 438 contacts an end portion 439 escape lever 22' but does not depress escape lever 22'. When the push bar 412 is in the outward position, escape lever 22' is in the normal or neutral position such that dead bolt 20 is extended. However, upon pushing the push bar 412 (FIG. 18B), roller member 444 (which may define an end portion of the escape lever 22') extending between arms 84' of modified escape lever 22' cams against the inner face or portion 438 of push bar 412 to thereby force escape lever 22' inwardly. Upon the inward movement of escape lever 22', the dead bolt 20 is retracted in the same manner as described above with respect to the pushing or inward movement of escape lever 22. As the push bar 412 is pushed (such as an outer portion 413 thereof), support flanges 428 of biasing bar 427 are also directed inwardly, thus pivoting the member 420 about pivot points 446, which is at the connections between the middle portion 420*c* of the member 420 and the support flanges 418 of mounting plate 416. The pivoting at each pivot point 446 of the resilient members 420 causes the second end 420*b* of each member 420 to direct the rod 426 to the right, as viewed from FIGS. 18A-C. The pin 427 also moves, thereby compressing spring 426 between the pin 427 and support structure 422 to a compressed state, as shown in FIG. 18B. Referring to FIG. 18C, when the push bar 412 is released, spring 246 biases back to the relaxed state, thereby moving pin 427 and rod 425 to the left to cause the push bar 412 to return to its normal position. However, although push bar 412 biases back to the normal position shown in FIG. 18C, escape lever 22' is maintained in the inward position upon retraction of the dead bolt 20 and until the dead bolt 20 is again extended, as similarly described with respect to system 10. As shown, because the escape lever 22' is maintained in the inward position, end portion 439 of the escape lever 22' remains in a position spaced from inner portion 438 of push bar 412.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A dead bolt lock system for use on a door, the lock system comprising:

a housing structure adapted to be mounted on an inside of a door;

a dead bolt mounted in the housing for movement between extended and retracted positions;

a slider member movable between first and second positions and operatively coupled to the dead bolt such that when the slider member is in the first position, the dead bolt is in the extended position, and when the slider member is in the second position, the dead bolt is in the retracted position;

a first movable member positioned in a path of movement of the slider member and configured to be displaced by the slider member to thereby allow the slider member to move to the second position;

a second movable member positioned in a path of movement of the first movable member such that displacement of the first movable member by the slider member also displaces the second movable member;

a first lock having a first condition preventing the displacement of the first movable member and a second condition allowing the displacement of the first movable member; and a second lock having a first condition preventing the displacement of the first movable member and a second condition allowing the displacement of the first movable member;

wherein the slider member is movable along a first plane and the first movable member is positioned to intersect the first plane before being displaced by the slider member and to no longer intersect the first plane after being displaced by the slider member, and wherein the slider member is movable along a first axis, wherein at least one of the first or second movable members rotates about a second axis when being displaced, the second axis being transverse to the first axis.

2. The dead bolt lock system of claim 1, wherein when one of the first or second locks is in its respective first condition, displacement of both of the first and second movable members is prevented.

3. The dead bolt lock system of claim 1, wherein the first movable member rotates during displacement thereof by the slider member.

4. The dead bolt lock system of claim 1, wherein the second movable member cams along a cam portion of the first movable member as the first movable member is displaced.

5. The dead bolt lock system of claim 1, wherein the first and second movable members are configured to interact in a cammed relationship.

6. The dead bolt lock system of claim 1, wherein when the slider member is in the first position, a leading edge of the slider member substantially abuts the first movable member.

7. The dead bolt lock system of claim 1, wherein at least one of the first or second movable members is configured to move along a second plane parallel to the first plane as the slider member moves from the first position to the second position.

8. The dead bolt lock system of claim 1, wherein the first movable member interacts with the slider member in a cammed relationship when being displaced by the slider member.

9. The dead bolt lock system of claim 1, wherein the second axis is perpendicular to the first axis.

10. The dead bolt lock system of claim 1, wherein at least one of the first or second locks includes a lock bolt, wherein the lock bolt is in an extended position in the first condition thereof and the lock bolt is in a retracted position in the second condition thereof.

11. The dead bolt lock system of claim 1, further comprising a dead bolt retracting structure operatively connecting the slider member and the dead bolt.

12. The dead bolt lock system of claim 1, wherein:

at least one of the first or second locks includes a lock bolt, the lock bolt movable between extended and retracted positions along a second plane, the second plane substantially parallel to the first plane.

13. A dead bolt lock system for use on a door, the lock system comprising:

a housing structure adapted to be mounted on an inside of a door;

a dead bolt mounted in the housing for movement between extended and retracted positions;

a slider member movable between first and second positions and operatively coupled to the dead bolt such that when the slider member is in the first position, the dead bolt is in the extended position, and when the slider member is in the second position, the dead bolt is in the retracted position;

a first movable member positioned in a path of movement of the slider member and configured to be displaced by the slider member to thereby allow the slider member to move to the second position;

a second movable member positioned in a path of movement of the first movable member such that displacement of the first movable member by the slider member also displaces the second movable member;

a first lock having a first condition preventing the displacement of the first movable member and a second condition allowing the displacement of the first movable member;

a second lock having a first condition preventing the displacement of the first movable member and a second condition allowing the displacement of the first movable member;

wherein the slider member is movable along a plane and the first movable member is positioned to intersect the plane before being displaced by the slider member and to no longer intersect the plane after being displaced by the slider member;

wherein the second movable member cams along a cam portion of the first movable member as the first movable member is displaced, and wherein the cam portion includes a first portion having a first cross-sectional dimension and a second portion having a second cross-sectional dimension, the second cross-sectional dimension being greater than the first cross sectional dimension, wherein the second movable member cams from the first portion to the second portion as the first movable member rotates.

14. A dead bolt lock system for use on a door, the lock system comprising:

a housing structure adapted to be mounted on an inside of a door;

a shaft adapted to be rotated by a first handle, the shaft located on and extending from a first side of the housing structure;

a dead bolt mounted in the housing for movement between extended and retracted positions;

a lock operatively coupled with the dead bolt and controlled by the input of correct unlocking information to allow movement of the dead bolt from the extended position to the retracted position;

a dead bolt retracting structure operatively connected to the dead bolt such that when the lock is unlocked, at least a portion of the dead bolt retracting structure is operative to allow retraction of the dead bolt by the first handle and, when the lock is locked, operation of the dead bolt retracting structure by the first handle is prevented thereby preventing retraction of the dead bolt; and an escape lever located on and extending from a second side of the housing structure opposite to the first side of the housing structure, the escape lever having a second handle and a movable arm interacting with the dead bolt retracting structure, the escape lever being configured to retract the dead bolt when the lock is in the locked condition and when the lock is in the unlocked condition, the escape lever operable to retract the dead bolt with at least one of a pushing motion in a first direction whereby the second handle moves to a first position relative to the door, or a pulling motion in a second direction whereby the second handle moves to a second position relative to the door;

wherein the second handle is configured to reside in the first position or second position upon a pushing motion or pulling motion resulting in retraction of the dead bolt, respectively, until the dead bolt moves towards the extended position.

15. A dead bolt lock system for use on a door, the lock system comprising:

a housing structure adapted to be mounted on an inside of a door;

a shaft adapted to be rotated by a door handle, the shaft located on and extending from a first side of the housing structure;

a dead bolt mounted in the housing for movement between extended and retracted positions;

a lock operatively coupled with the dead bolt and controlled by the input of correct unlocking information to allow movement of the dead bolt from the extended position to the retracted position;

a dead bolt retracting structure operatively connected to the dead bolt such that when the lock is unlocked, at least a portion of the dead bolt retracting structure is operative to allow retraction of the dead bolt by the door handle and, when the lock is locked, operation of the dead bolt retracting structure by the door handle is prevented thereby preventing retraction of the dead bolt; and an escape lever located on and extending from a second side of the housing structure opposite to the first side of the housing structure, the escape lever including a movable arm interacting with the dead bolt retracting structure, the escape lever being configured to retract the dead bolt when the lock is in the locked condition and when the lock is in the unlocked condition, the escape lever operable to retract the dead bolt with at least one of a pushing motion in a first direction, or a pulling motion in a second direction, wherein when the pushing motion is used and when the pulling motion is used, the movable arm is configured to move generally in a direction that is opposite of a direction of movement of the dead bolt as the dead bolt moves from the extended position to the retracted position.

16. A method of retracting a dead bolt of a dead bolt lock system, the system including a dead bolt operatively coupled to a slider member, the slider member movable between a first position whereby the dead bolt is in an extended position and a second position whereby the dead bolt is in a retracted position, a first movable member positioned in a path of movement of the slider member and prevented from being displaced by first and second locks in a locked condition, and a second movable member positioned in a path of movement of the first movable member, the method comprising:

unlocking the first lock and the second lock; and moving the slider member along a first plane from the first position to the second position, whereby the first movable member and the second movable member are displaced and the first movable member is displaced out of the path of movement of the slider member such that the first movable member no longer intersects the first plane after being displaced, and wherein the second movable member cams from a first cross-sectional dimension portion of the first movable member to a second cross-sectional dimension portion of the first movable member as the first movable member is displaced, the second cross-sectional dimension being greater than the first cross-sectional dimension.

17. The method of claim 16, wherein displacing the second movable member further comprises:

camming the second movable member along a cam portion of the first movable member as the first movable member is displaced.

18. The method of claim 16, wherein one of the first or second movable members moves along a second plane parallel to the first plane as the slider member moves from the first position to the second position.

19. The method of claim 16, wherein the first movable member rotates during displacement thereof by the slider member.

20. The method of claim 16, wherein at least one of the first or second locks includes a lock bolt, the lock bolt movable between extended and retracted positions along a second plane, the second plane substantially parallel to the first plane.

21. A method of retracting a dead bolt of a dead bolt lock system, the system including a dead bolt operatively coupled to a slider member, the slider member movable between a first position whereby the dead bolt is in an extended position and a second position whereby the dead bolt is in a retracted position, a first movable member positioned in a path of movement of the slider member and prevented from being displaced by first and second locks in a locked condition, and a second movable member positioned in a path of movement of the first movable member, the method comprising:

unlocking the first lock and the second lock; and moving the slider member along a first plane from the first position to the second position, whereby the first movable member and the second movable member are displaced and the first movable member is displaced out of the path of movement of the slider member such that the first movable member no longer intersects the first plane after being displaced, wherein the slider member moves along a first axis and at least one of the first or second movable members rotates about a second axis when being displaced, the second axis being transverse to the first axis.

22. The method of claim 21, wherein the second axis is substantially perpendicular to the first axis.

23. A method of retracting a dead bolt of a dead bolt lock system associated with a door, the dead bolt lock system including a dead bolt, a lock operatively coupled with the dead bolt and controlled by the input of correct unlocking information to allow movement of the dead bolt from an extended position to a retracted position, a dead bolt retracting structure operatively connected to the dead bolt, and an escape lever including a movable arm interacting with the dead bolt retracting structure to retract the dead bolt, the escape lever having a neutral position where the dead bolt is in the extended position, an inward position where the dead bolt is in the retracted position, and an outward position where the dead bolt is in the retracted position, the method comprising:

actuating the escape lever to operate the retracting structure to thereby retract the dead bolt regardless of whether the lock is locked or unlocked, wherein:

when a pushing motion in a first direction is used to actuate the escape lever, the escape lever remains in the inward position until the dead bolt moves towards the extended position; and when a pulling motion in a second direction is used to actuate the escape lever, the escape lever remains in the outward position until the deadbolt moves towards the extended position.

24. The method of claim 23, wherein closing the door after the dead bolt has been retracted causes the dead bolt to extend, and causes the escape lever to return to the neutral position.

25. The method of claim 24, wherein the neutral position is between the inward position and the outward position.

26. A method of retracting a dead bolt of a dead bolt lock system, the dead bolt lock system including a dead bolt, a lock operatively coupled with the dead bolt and controlled by the input of correct unlocking information to allow movement of the dead bolt from an extended position to a retracted position, a dead bolt retracting structure operatively connected to the dead bolt, and an escape lever including a movable arm interacting with the dead bolt retracting structure to retract the dead bolt, the method comprising:

actuating the escape lever with one of a pushing motion and a pulling motion to operate the dead bolt retracting structure and thereby retract the dead bolt regardless of whether the lock is locked or unlocked, wherein when the pushing motion is used and when the pulling motion is used the movable arm moves generally in a direction that is opposite of a direction of movement of the dead bolt as the dead bolt moves from the extended position to the retracted position.

27. A dead bolt lock system for use on a door, the lock system comprising:

a housing structure adapted to be mounted on an inside of a door;

a shaft adapted to be rotated by a first handle, the shaft located on and extending from a first side of the housing structure;

a dead bolt mounted in the housing for movement between extended and retracted positions;

a lock operatively coupled with the dead bolt and controlled by the input of correct unlocking information to allow movement of the dead bolt from the extended position to the retracted position;

a dead bolt retracting structure operatively connected to the dead bolt such that when the lock is unlocked, at least a portion of the dead bolt retracting structure is operative by the first handle to allow retraction of the dead bolt and, when the lock is locked, operation of the dead bolt retracting structure by the first handle is prevented thereby preventing retraction of the dead bolt; and an escape lever located on and extending from a second side of the housing structure opposite to the first side of the housing structure, the escape lever having a second handle and a movable arm interacting with the dead bolt retracting structure, the escape lever being configured to retract the dead bolt when the lock is in the locked condition and when the lock is in the unlocked condition, the escape lever operable to retract the dead bolt with at least one of a pushing motion in a first direction whereby the second handle moves to a first position relative to the door, or a pulling motion in a second direction whereby the second handle moves to a second position relative to the door;

wherein the second handle is configured to reside in the first position or second position upon a pushing motion or pulling motion resulting in retraction of the dead bolt, respectively, until the dead bolt moves towards the extended position.

* * * * *